US007341810B2

(12) United States Patent
Kurimoto et al.

(10) Patent No.: US 7,341,810 B2
(45) Date of Patent: Mar. 11, 2008

(54) ELECTROPHOTOGRAPHIC PHOTORECEPTOR METHOD OF MANUFACTURING ELECTROPHOTOGRAPHIC PHOTORECEPTOR, AND ELECTROPHOTOGRAPHIC APPARATUS AND PROCESS CARTRIDGE USING ELECTROPHOTOGRAPHIC PHOTORECEPTOR

(75) Inventors: Eiji Kurimoto, Numazu (JP); Yasuyuki Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 417 days.

(21) Appl. No.: 10/943,196

(22) Filed: Sep. 17, 2004

(65) Prior Publication Data

US 2005/0058918 A1 Mar. 17, 2005

(30) Foreign Application Priority Data

Sep. 17, 2003 (JP) ..... 2003-324986
Nov. 20, 2003 (JP) ..... 2003-391070

(51) Int. Cl.
*G03G 15/02* (2006.01)

(52) U.S. Cl. ..... 430/59.2; 430/58.05; 430/59.1

(58) Field of Classification Search ..... 430/59.2, 430/58.05, 59.1; 399/159
See application file for complete search history.

(56) References Cited

U.S. PATENT DOCUMENTS 4,400,455 A * 8/1983 Hashimoto et al. ..... 430/58.45
4,481,271 A * 11/1984 Hashimoto et al. ..... 430/58.4
4,618,672 A * 10/1986 Hashimoto ..... 534/658
5,578,405 A 11/1996 Ikegami et al.
5,702,855 A 12/1997 Ikegami et al.
5,824,444 A 10/1998 Kinoshita et al.
6,337,165 B1 1/2002 Fujii et al.
6,432,596 B2 8/2002 Ikuno et al.
6,573,016 B2 6/2003 Kami et al.
6,641,964 B2 11/2003 Ikuno et al.
6,790,572 B2 9/2004 Tamoto et al.
2003/0059693 A1 3/2003 Ikegami et al.

FOREIGN PATENT DOCUMENTS

JP 06-313972 11/1994
JP 07-013374 1/1995
JP 07-043920 2/1995
JP 07-044065 2/1995
JP 07-092701 4/1995

(Continued)

OTHER PUBLICATIONS

U.S. Appl. No. 10/384,662, filed Mar. 11, 2003, Kawasaki et al.

(Continued)

*Primary Examiner*—Mark A. Chapman
(74) *Attorney, Agent, or Firm*—Oblon, Spivak, McClelland, Maier & Neustadt, P.C.

(57) ABSTRACT

An electrophotographic photoreceptor comprising a conductive substrate, an undercoat layer located overlying the conductive substrate, a photosensitive layer located overlying the undercoat layer. The photosensitive layer has a charge generation layer located overlying the undercoat layer and a charge transport layer located overlying the charge generation layer. In addition, when the charge generation layer is irradiated in the absence of the charge transport layer with light in a range of from 360 nm to 740 nm having the highest reflectivity for the charge generation layer, the charge generation layer has a reflectivity of from 15 to 21%.

18 Claims, 7 Drawing Sheets

FOREIGN PATENT DOCUMENTS

| | | |
|---|---|---|
| JP | 08-022136 | 1/1996 |
| JP | 08-146639 | 6/1996 |
| JP | 08-152721 | 6/1996 |
| JP | 09-211876 | 8/1997 |
| JP | 09-258469 | 10/1997 |
| JP | 10-069104 | 3/1998 |
| JP | 10-073942 | 3/1998 |
| JP | 10-115946 | 5/1998 |
| JP | 10-123802 | 5/1998 |
| JP | 10-123855 | 5/1998 |
| JP | 10-123856 | 5/1998 |
| JP | 10-177261 | 6/1998 |
| JP | 10-177262 | 6/1998 |
| JP | 10-177263 | 6/1998 |
| JP | 10-177269 | 6/1998 |
| JP | 10-186696 | 7/1998 |
| JP | 10-246997 | 9/1998 |
| JP | 11-133825 | 5/1999 |
| JP | 11-184127 | 7/1999 |
| JP | 11-184135 | 7/1999 |
| JP | 2000-075521 | 3/2000 |
| JP | 2000-105478 | 4/2000 |
| JP | 2000-112162 | 4/2000 |
| JP | 2000-147803 | 5/2000 |
| JP | 2000-231246 | 8/2000 |
| JP | 2000-292946 | 10/2000 |
| JP | 2001-051438 | 2/2001 |
| JP | 2001-117244 | 4/2001 |
| JP | 2001-235889 | 8/2001 |
| JP | 2001-305762 | 11/2001 |
| JP | 2001-305763 | 11/2001 |
| JP | 2002-006528 | 1/2002 |
| JP | 2002-107972 | 4/2002 |
| JP | 2002-107983 | 4/2002 |
| JP | 2002-123067 | 4/2002 |

OTHER PUBLICATIONS

U.S. Appl. No. 10/135,548, filed May 1, 2002, Tamoto et al.
U.S. Appl. No. 10/103,791, filed Mar. 25, 2002, Suzuki et al.
U.S. Appl. No. 11/403,012, filed Apr. 13, 2006, Toda.
U.S. Appl. No. 11/519,098, filed Sep. 12, 2006, Toda et al.
U.S. Appl. No. 11/736,919, filed Apr. 18, 2007, Shimoyama et al.

* cited by examiner

ELECTROPHOTOGRAPHIC PHOTORECEPTOR METHOD OF MANUFACTURING ELECTROPHOTOGRAPHIC PHOTORECEPTOR, AND ELECTROPHOTOGRAPHIC APPARATUS AND PROCESS CARTRIDGE USING ELECTROPHOTOGRAPHIC PHOTORECEPTOR

BACKGROUND OF THE INVENTION

1. Field of the Invention

The present invention relates to an electrophotographic photoreceptor, a method of manufacturing the photoreceptor, and an electrophotographic apparatus and a process cartridge using the electrophotographic photoreceptor. More particularly, the present invention relates to an electrophotographic photoreceptor for use in electrophotographic apparatus such as copiers, facsimiles, laser printers, and direct digital plate making machines, and a method of manufacturing the photoreceptor, and an electrophotographic apparatus and a process cartridge using the electrophotographic photoreceptor.

2. Discussion of the Background

The photosensitive material used in the photoreceptors for use in an electrophotographic apparatus such as copiers and laser printers has changed from inorganic photosensitive materials such as selenium, zinc oxide and cadmium sulfide to organic photosensitive materials. This is because organic photosensitive materials are friendly to environment, have low manufacturing costs; and good designing flexibility.

Organic photoreceptors are broadly classified into the following three types:

(1) homogeneous single-layered photoreceptors in which, for example, a photoconductive resin such as polyvinyl carbazole (PVK) or a charge transfer complex such as PVK-TNF (2,4,7-trinitrofluorenone) is formed on an electroconductive substrate;

(2) dispersion type single-layered photoreceptors in which a resin layer including a pigment such as phthalocyanine and perylene dispersed in the resin is formed on an electroconductive substrate; and (3) functionally-separated multi-layered photoreceptors in which a charge generation layer (hereinafter referred to as a CGL) including a charge generation material (hereinafter referred to as a CGM) and a charge transport layer (hereinafter referred to as a CTL) including a charge transport material (hereinafter referred to as a CTM) are overlaid on an electroconductive substrate.

The functionally-separated multi-layered photoreceptors typically have a structure in which a CTL is formed on a CGL. The functionally-separated multi-layered photoreceptors having a reverse structure are sometimes referred to as reverse-layered photoreceptors.

Particularly, the functionally-separated multi-layered photoreceptors have advantages on photosensitivity and good flexibility in designing photoreceptors having high photosensitivity and good durability. Therefore, recently the functionally-separated multi-layered photoreceptors have been widely used for electrophotographic apparatus.

In recent years, a small-sized electrophotographic apparatus which can produce quality images at a high speed has been increasingly demanded. In addition, a polymerized toner having a sphere form and a small diameter (i.e., not greater than 6 μm) now tends to be selected for use in developing images.

To produce high quality images with the demanded high speed rate, the electrophotographic apparatus forms images with high density. This causes an image deterioration problem referred to as "residual image" or "ghost" in many cases. Thus actually there is no perfect electrophotographic apparatus capable of producing high quality images at a high speed as demanded.

The residual image phenomena are now described.

When an image having only distinctive light image portions and dark image portions is formed and then a half-tone image is formed as illustrated in FIG. 9, a residual image (positive or negative image) of the image is observed in the half-tone image in some cases. These images are referred to as "a positive residual image" or "a positive ghost image" (illustrated in FIG. 10) and "a negative residual image" or "a negative ghost image" (illustrated in FIG. 11). It is necessary to prevent formation of such a residual image particularly in a high quality full color electrophotographic apparatus.

The mechanism of formation of a residual image is considered to be caused by fluctuation of the surface potential of the photoreceptor as discussed in published unexamined Japanese Patent Application No. (hereinafter referred to as JOP) 11-133825. The fluctuation of the surface potential of the photoreceptor in each process of latent image formation, development and transfer is explained with reference to FIG. 12.

FIG. 12A illustrates the surface potential of a photoreceptor when the photoreceptor is charged to uniformly have a potential of −700 V and then exposed to imagewise light (i.e., the surface potential of a latent electrostatic image formed on the photoreceptor). In this case, the surface potential of the exposed portion is about 0 V. FIG. 12B illustrates the surface potential of the photoreceptor when the latent image is developed with a toner (i.e., the surface potential of the photoreceptor having a toner image thereon) due to the potential difference between the development potential and the surface of the photoreceptor. FIG. 12C illustrates the surface potential of the photoreceptor after the toner image is transferred onto a receiving paper while a reverse bias is applied to the receiving paper. In this case, the exposed portions have a certain positive potential (for example, +10 V in FIG. 17C).

When the photoreceptor is charged after these image forming processes are repeated, the surface potential (for example, −690 V) of the former image portion is lower than that (i.e., −700 V) of the other portions. If a half-tone image is formed on an area including the former image portion and a former non-image portion, the difference in potential between the former image portion and a non-lighted portion is larger than that between the former non-image portion and the non-lighted portion, and thereby a dense image (a positive image) is formed on the former image portion.

As discussed in JOP 2002-123067, the residual image problem also occurs in a digital image forming method in which half tone images constituted of digital dot images are formed as widely used in the inkjet printing methods.

Specifically, the illuminance in a beam spot formed on a photoreceptor to form a latent dot image thereon is not uniform and has a certain distribution in a direction from the center to the periphery of the beam spot. When a beam spot is formed on the former image portion, the resultant latent dot image portion has a larger area than the other latent dot image portions because the potential of the latent dot image portion is biased by, for example, +10 V. Thus, the resultant dot toner image has a larger diameter than that of the dot image in other portions, and thereby the portions of the widened dot image potions are observed to be dense, resulting in formation of a residual positive image. This phenomenon is more apparent in high definition image formation, for example, in image formation with a resolution of 1200 dpi than with a resolution of 600 dpi.

As discussed in JOP 10-177261, fluctuation of the surface potential is considered to be mainly caused by storage of space charges inside a photoreceptor. In attempting to prevent the storage of space charges, the following methods have been disclosed.

(1) Improvement of Outermost Layer of Photoreceptor

JOP 10-115946 discloses a photoreceptor having an outermost layer which comprises a polyarylate resin and which has a dielectric constant not less than 2.3.

JOP 11-184135 discloses a photoreceptor having a photosensitive layer including an azo pigment and an outermost layer including a polyarylate resin. According to the publication, polyarylate resins have high crystallinity, and therefore can orient the CTM included therein to some extent. It is considered that by orienting the CTM and using the specific azo pigment, the charge injection barrier can be decreased and thereby the photo-memory property of the photoreceptor is diminished.

JOP 10-177263 discloses that a photoreceptor having a CGL including a phthalocyanine compound and an outermost layer including a bisphenol-based polycarbonate is used for an electrophotographic apparatus having an intermediate transfer medium. It is considered that the effect is produced by the combination of the specific compounds.

JOP 10-177264 discloses that a photoreceptor having a CGL including a phthalocyanine compound and an outermost layer including a charge transport polymer is used for an electrophotographic apparatus having an intermediate transfer medium. It is considered that the effect is produced by the combination of the specific compounds.

JOP 10-177269 discloses that a photoreceptor having a CGL including a phthalocyanine compound and either an insulating outermost layer or a semiconductive outermost layer including at least a resistance controlling agent is used for an electrophotographic apparatus having an intermediate transfer medium. It is considered that the effect is produced by the combination of the specific compounds.

JOP 2000-147803 discloses a photoreceptor in which a polycarbonate copolymer obtained from bisphenol A and a monomer having a specific arylene group is used for the outermost layer thereof such as the CTL. It is discussed in the publication that injection of charges having a reverse polarity from the outermost layer side can be prevented.

JOP 2001-235889 discloses a photoreceptor having an outermost layer including a surface-treated particulate metal oxide, an alcohol-soluble resin and an alcohol-soluble CTM. It is described in the publication that thermoplastic resins cannot be used as the binder resin of the outermost layer because the resins have insufficient mechanical strength and solvents used for dissolving the resins also dissolve the photosensitive layer. It is considered that use of an alcohol-soluble CTM prevents formation of residual images.

JOP 2002-6528 discloses a photoreceptor having a photosensitive layer and a protective layer including at least one of an alkali metal element and an alkaline earth metal element. It is described therein that by including such an element in the protective layer, ionic conduction properties can be imparted to the protective layer, and thereby a photoreceptor which has good durability and which does not store residual charges can be provided. It is also described therein that it is possible to reduce the residual charges by including a CTM in the protective layer but the abrasion resistance of the protective layer is weak.

(2) Improvement of Photosensitive Layer

JOP 2000-75521 discloses a photoreceptor including at least one of a chlorogallium phthalocyanine compound and a hydroxygallium phthalocyanine compound as a CGM and a CTM having a hydrazone skeleton. It is described in the publication that the combination of the specific CGM and CTM can diminish the transfer memory property and photo-memory property of the photoreceptor.

JOP 2000-105478 discloses a photoreceptor having a photosensitive layer including an azo pigment which is for use in an electrophotographic apparatus using a laser diode emitting light with relatively short wavelength of from 380 to 500 nm as image writing light. It is considered that the azo pigments used therein have relatively weak photo-memory property compared to α-titanylphthalocyanine.

JOP 2001-305762 discloses a photoreceptor including a CGM and a CTM, wherein the CTM comprises a first compound having a polarizability greater than 70 Å which is calculated by structure optimizing calculation using semiempirical molecular orbital calculation using PM3 parameter and having a dipole moment less than 1.8 D which is calculated by the structure optimizing calculation, and a second compound having 50% transmittance at a longer wavelength than the first compound. It is described therein that the second compound absorbs extra light irradiating the photoreceptor, and thereby the photo-memory property of the photoreceptor can be diminished.

(3) Improvement of CTL

JOP 7-92701 discloses a multi-layered photoreceptor in which an oxytitanium phthalocyanine is included in the CGL and at least two kinds of CTMs are included in the CTL, wherein the difference in oxidation potential between the at least two kinds of CTMs is not greater than 0.04 V. It is considered that by using CTMs having almost the same energy level, hopping of the charge carriers between the CTMs can easily occur and the chance of trapping of charge carriers by the CTMs can be decreased, thereby decreasing the quantity of electrons excited by reverse charging performed by a transfer device, resulting in prevention of occurrence of the residual image problem.

JOP 08-152721 discloses a photoreceptor which is used for a back-lighting type high speed electrophotographic apparatus in which the exposure-development interval is from 10 to 150 msec, wherein the CTL of the photoreceptor has a charge mobility not less than $1\times10^{-6}$ $cm^2/V\cdot sec$ at an electric field of $2\times10^6$ V/cm. It is described therein that when a photoreceptor has a low dynamic photosensitivity, the latent image formation cannot be completed before the start of the developing operation and thereby the potential of the former image portions is increased after repeated use; but by using the technique mentioned above, the dynamic photosensitivity can be improved and thereby the residual image problem can be solved.

JOP 10-177262 discloses a photoreceptor which is for use in electrophotographic apparatus having an intermediate transfer medium and which has a CGL including a phthalocyanine compound and a CTL including a compound selected from triphenylamine compounds and N,N,N',N'-tetraphenylbenzidine compounds. It is considered that the effect is produced by the combination of the specific compounds.

(4) Improvement of CGL

JOP 06-313972 discloses a photoreceptor in which the thickness of the CGL is increased so as to be not less than 25 μm or the content of a CGM in the CGL is increased so as to be not less than 50% by weight so that a number of charge carriers are trapped in the CGL, to make the resultant ghost image inconspicuous.

JOP 10-69104 discloses a multi-layered photoreceptor having a CGL including a triarylamine compound having a xylyl group. It is described in the publication that a barrier to carrier transportation is formed at the interface between the CGL and CTL, and charge carriers are trapped thereby. Since the trapped carriers decrease the space electric field in the CGL, the potential of a half-tone image portion is not decreased, and thereby a residual image is formed at the portion. By including a CTM (i.e., a triarylamine compound having a xylyl group), the generated carriers are rapidly injected into the CTL and transported therethrough, and thereby accumulation of trapped carriers (i.e., occurrence of the residual image problem) can be prevented.

JOP 10-186696 discloses a photoreceptor having an electroconductive substrate and at least a photosensitive layer and a protective layer located overlying the substrate in this order, wherein the photosensitive layer comprises oxytitanium phthalocyanine having an Cu Kα X-ray diffraction spectrum in which strong peaks are observed at Bragg (2θ) angles of 9.5°, 24.1° and 27.3°. It is considered that the effect can be produced by the specific compound.

JOP 2002-107972 discloses a photoreceptor having a CGL including a hydroxygallium phthalocyanine compound and a butyral resin which serves as the binder resin and which has an acetal group, an acetyl group and a hydroxyl group, wherein the butyral resin has a butyralation degree not less than 62% by mole, a weight average molecular weight (Mw) not less than $2.0\times10^5$ and a number average molecular weight not less than $5.0\times10^4$. It is considered that the number of photo-carriers can be reduced by the specific polyvinyl butyral, and thereby occurrence of the residual image problem can be prevented.

(5) Improvement by Matching CGL with CTL

JOP 07-43920 discloses a multi-layered photoreceptor in which a specific azo pigment is used for the CGL and a CTM having a fluorene skeleton is used for the CTL. It is considered that addition of the specific compounds prevents the photoreceptor from suffering light fatigue. It is considered that the effect can be produced by the specific compound.

JOP 09-211876 discloses a negative polarity-type photoreceptor having a high γ property, in which a CGL including a phthalocyanine compound and a p-type CTL including a material selected from the group consisting of inorganic p-type semiconductors and particulate t-Se and charge transport polymers are used. It is described therein that the p-type CTL is characterized by including no positive hole transport material and thereby diffusion of a positive hole transport material into the CGL can be prevented. Therefore, trapping caused by the phthalocyanine pigment can be prevented and thereby the residual image problem can be prevented.

(6) Improvement of Undercoat Layer

JOP 08-22136 discloses a photoreceptor having an undercoat layer including a silane coupling agent and an inorganic filler. It is described therein that by forming such an undercoat layer, charges to be flown to the substrate are smoothly flown to the substrate, and thereby occurrence of the residual image problem can be prevented.

In addition, JOP 11-184127 discloses a photoreceptor having an undercoat layer including a resin having a specific polyamide acid or polyamide acid ester structure or a polyimide structure, and a resin having a cyanoethyl group. It is considered that by using such resins, the photoreceptor is prevented from suffering light fatigue.

JOP 2000-112162 discloses a photoreceptor having an undercoat layer including a crosslinking resin which hardly changes its resistance even when the environmental humidity changes. It is described therein that JOP 08-146639 discloses an undercoat layer including a polycyclic quinone, perylene, etc.; JOP 10-73942 discloses an undercoat layer including a metallocene compound, an electron accepting compound and a melamine resin; JOP 08-22136 discloses an undercoat layer including a particulate metal oxide and a silane coupling agent; and JOP 09-258469 discloses an undercoat layer including a particulate metal oxide having a surface treated with a silane coupling agent.

It is described therein that in a high sensitive photoreceptor including oxytitanium phthalocyanine in its CGL, a large number of molecules and carriers are excited, and therefore there is a large number of molecules which do not cause charge separation; in addition a large number of electrons and holes tend to remain in the photoreceptor in an electrophotographic process in which charging and light irradiating are repeated.

In attempting to solve the problem, JOP 2000-112162 proposes to use a combination of a polyamide resin and a zirconium compound or a combination of a polyamide resin, a zirconium alkoxide and a diketone compound such as acetyl acetone for the undercoat layer. In addition, JOP 2001-51438 proposes to use a combination of a cellulose resin, a zirconium compound, a zirconium alkoxide, and a diketone compound for the undercoat layer.

JOP 2001-305763 discloses a photoreceptor having an undercoat layer, including a CGM and a CTM, wherein the CTM comprises a material having a polarizability greater than 70 Å which is calculated by structure optimizing calculation using semiempirical molecular orbital calculation using PM3 parameter and having a dipole moment less than 1.8 D which is calculated by the structure optimizing calculation, and a specific arylamine compound, wherein the undercoat layer comprises a particulate titanium oxide treated with an organic silicon compound and a polyamide having a specific diamine component as a constituent. It is considered in the publication that by forming such an undercoat layer, the carriers remaining in the photosensitive layer can be easily transported.

JOP 2002-107983 discloses a system in which the undercoat layer of the photoreceptor has a volume average resistivity of from $10^{10}$ to $10^{12}$ Ω·cm, the CTL thereof has a thickness not greater than 18 μm and the electrophotographic apparatus does not include a quencher. It is considered that by not using a quencher, the photoreceptor is prevented from suffering light fatigue, and since the undercoat layer has a proper resistance, injection of charges from the substrate to the photosensitive layer can be suppressed, resulting in prevention of accumulation of space charges in the photoreceptor.

(7) Addition of Additives

JOP 10-177261 discloses a photoreceptor for use in an electrophotographic apparatus having an intermediate transfer medium, wherein the photoreceptor has a CGL including a phthalocyanine compound and an outermost layer including a material having a hindered phenol structure. It is considered that the effect is produced by the specific material.

JOP 2000-292946 discloses a photoreceptor having a CGL including a phthalocyanine pigment and a dithiobenzyl compound. It is described therein that by using such materials, the photo-memory property of the photoreceptor can be diminished and thereby occurrence of the positive-ghost problem can be prevented.

(8) Improvement in Electrophotographic Process

JOP 07-13374 proposes a technique in that the photoreceptor used is sometimes charged reversely so as to have a reverse (positive) charge, and then allowed to settle.

In a photoreceptor having a high sensitive CTL, a large number of charge carriers are induced by light irradiation. In this case, electrons whose number is the same as that of the holes injected to the CTL are formed. If the electrons are not discharged to the substrate, the electrons remain in the CGL and thereby the residual image problem tends to occur. When such a photoreceptor is reversely (i.e., positively) charged, electrons are injected from the substrate and electron traps are formed in the CGL. When light irradiation is performed on such a photoreceptor, difference in the number of electron traps between the lighted portions and unexposed portions is little, and thereby the ghost image becomes inconspicuous.

JOP 07-44065 discloses a technique in that a DC voltage overlapped with an AC voltage is applied to the substrate of the photoreceptor. By applying a reverse bias to the substrate, electrons trapped in the CGL can be discharged therefrom. By overlapping an AC voltage, the electric current can be increased and thereby the reverse charge bias effect can be accelerated.

JOP 10-123802 discloses a technique in that charging (not main charging) is performed on a multi-layered photoreceptor having a CGL including a phthalocyanine compound and then light discharging is performed thereon, wherein the main charging is performed thereon if the predetermined portion of the photoreceptor reaches the main charging portion. It is described therein that by performing such an image forming method, the photoreceptor is charged after the space charges in the photoreceptor are released therefrom, and thereby occurrence of the residual image problem can be prevented.

JOP 10-123855 discloses a technique in that a controller is provided in an electrophotographic apparatus, which controls the transfer current flowing from a transfer device to the multi-layered photoreceptor used, wherein the photoreceptor has a CGL including a phthalocyanine compound. It is described therein that the greater the transfer current, the more conspicuously a negative residual image is formed. The reason is considered as follows. When an image is transferred, holes are injected into non-lighted portions of the photoreceptor and the holes are trapped at the interface of the CGL or the CTL on the substrate side. The trapped holes are released in the next charging process, and thereby the dark decay is enhanced (i.e., apparent sensitization), resulting in occurrence of formation of a negative residual image. Therefore, by controlling the transfer current, the number of charge carriers injected into the photoreceptor can also be controlled and occurrence of the residual image problem can be prevented.

JOP 2000-231246 proposes a technique in that the wavelength of the image writing light and the discharging light are determined depending on the ratio of photo-memory property before charging to the photosensitivity of the photoreceptor.

JOP 10-123856 proposes a technique in that light irradiation is performed on a photoreceptor having a CGL including a phthalocyanine compound before the transfer process to decrease the potential of the unexposed portion to ⅓ of the potential, in order to prevent occurrence of the residual image problem. It is considered that by performing such irradiation, the difference in potential between the exposed portion and the unexposed portion is reduced and thereby the residual image becomes inconspicuous.

JOP 10-246997 discloses a technique in that in an electrophotographic apparatus using a photoreceptor having a photosensitive layer and a protective layer including a light-curable acrylic resin, a humidity sensor is provided in the vicinity of the photoreceptor to change the current of the AC component of the voltage applied by the charger depending on the humidity. It is described therein that by using such a technique, chance of formation of blurred images can be decreased. In addition, it is described therein that the photo-memory property of the photoreceptor is weakened using the technique, but the mechanism thereof is not described therein.

JOP 2001-117244 discloses a technique in that in order to prevent formation of ghost images when a S-form photoreceptor is used, the period of half-decay of the potential on the photoreceptor in light irradiation, which period is determined using a Xerographic Time Of Flight (TOF) method, is controlled so as to be not greater than 1/10 of the exposure-development interval between the light irradiation process and the following development process.

As described in numbered paragraph (6) above, JOP 2002-107983 discloses a technique in that by not using a quencher, the photoreceptor is prevented from suffering light fatigue.

JOP 2002-123067 discloses a technique in that the photoreceptor and charging conditions are controlled so as to satisfy the following relationship: $|(V1-V2)/VH|<0.020$, wherein VH represents the potential of the charged photoreceptor; V1 represents the potential of the photoreceptor after a dark decay for a time of 10T, wherein T represents the charge-exposure interval; and V2 represents the potential of the photoreceptor after a dark decay for a time of 10 T, which photoreceptor is charged again after one round of charging followed by light irradiation has been completed. Specifically, a technique is described therein that the process speed is increased to have a short dark decay time or the photoreceptor is charged so as to have a relatively low potential.

Although the techniques described above are applied to prevent occurrence of residual images, it is found that these are not good enough to obtain an electrophotographic device having good durability and producing high quality images at a high speed. Thus, the residual image problem has not been fully solved.

Because of these reasons, a need exists for an electrophotographic apparatus which can produce high quality images at a high speed with good durability, good cleanability and good transferability while obviating the residual image problem.

SUMMARY OF THE INVENTION

Accordingly, an object of the present invention is to provide an electrophotographic photoreceptor capable of producing high quality images at a high speed and provising good durability, good cleanability and good transferability while obviating the residual image problem.

Another object of the present invention is to provide a method of manufacturing such a photoreceptor.

Yet another object of the present invention is to provide an image forming apparatus and a process cartridge which can produce high quality images at a high speed without causing the residual image problem and without frequently changing the photoreceptor.

Briefly these objects and other objects of the present invention as hereinafter will become more readily apparent are attained by an electrophotographic photoreceptor including a conductive substrate, an undercoat layer located overlying the conductive substrate, a photosensitive layer located overlying the undercoat layer. The photosensitive layer comprises a charge generation layer located overlying the undercoat layer and a charge transport layer located overlying the charge generation layer. In addition, when the charge generation layer is irradiated in the absence of the charge transport layer with light in a range of from 360 nm to 740 nm having a highest reflectivity for the charge generation layer, the charge generation layer has a reflectivity of from 15 to 21%.

It is preferred that, in the electrophotographic photoreceptor mentioned above, the charge generation layer comprises a disazo pigment represented by the following formula (I):

(I)

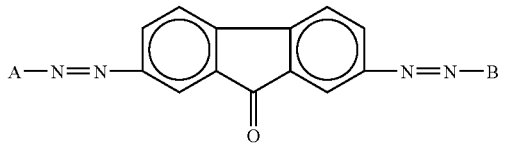

wherein, A and B represent coupler remaining groups represented by the following formulae (II) to (VIII);

(II)

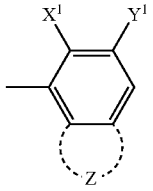

wherein, $X^1$ represents —OH, —$NHCOCH_3$, and —$NHSO_2CH_3$, $Y^1$ represents —$CON(R^2)(R^3)$, —$CONHN{=}C(R^6)(R^7)$, —$CONHN(R^8)(R^9)$, —$CONHCONH(R^{12})$, a hydrogen atom, COOH, —$COOCH_3$, $COOC_6H_5$ and a benzimidazol group, wherein $R^2$ and $R^3$ independently represent a hydrogen atom, a substituted or non-substituted alkyl group, a substituted or non-substituted aryl group and a substituted or non-substituted heterocyclic group or wherein $R^2$ and $R^3$ when taken together can form a ring with the nitrogen atom they are bonded to, $R^6$ and $R^7$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^6$ and $R^7$ when taken together can form a ring with the nitrogen atom they are bonded to, $R^8$ and $R^9$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^8$ and $R^9$ when taken together with the carbon atom they are bonded to can form a five-membered ring or six-membered ring optionally having a condensed aromatic ring, and $R^{12}$ represents a substituted or non-substituted alkyl group, a substituted or non-substituted aryl group and a substituted or non-substituted heterocyclic group, and Z represents a remaining group which is fused with the benzene ring to form a polycyclic aromatic structure or a heterocyclic structure selected from the group consisting of a naphthalene ring, an anthracene ring, a carbazole ring, a benzocarbazole ring, a dibenzocarbazole ring, a dibenzofuran ring, a benzonaphthofuran ring and a dibenzothiophene ring, each of which can have at least one substituent;

(III)

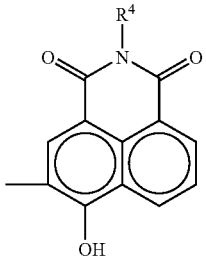

wherein $R^4$ represents a hydrogen atom, a substituted or non-substituted alkyl group, and a substituted or non-substituted aryl group;

(IV)

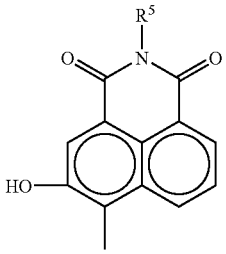

wherein $R^5$ represents a hydrogen atom, a substituted or non-substituted alkyl group, and a substituted or non-substituted aryl group;

(V)

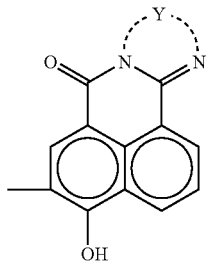

wherein Y represents a divalent aromatic hydrocarbon group or wherein Y together with the N-atoms it is bonded to forms a heterocyclic group;

(VI)

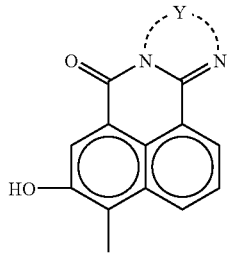

wherein Y represents a divalent aromatic hydrocarbon or wherein Y together with the N-atoms it is bonded to forms a heterocyclic group;

(VII)

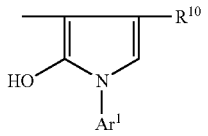

wherein $R^{10}$ represents a hydrogen atom, an alkyl group, a carboxyl group, and a carboxyester group and $Ar^1$ is a substituted or non-substituted aromatic hydrocarbon group; and (VIII)

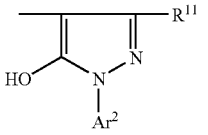

wherein $R^{11}$ represents a hydrogen atom, an alkyl group, a carboxyl group, and a carboxyester and $Ar^2$ is a substituted or non-substituted aromatic hydrocarbon group.

It is still further preferred that, the electrophotographic photoreceptor mentioned above, the charge generation layer comprises a disazo pigment represented by the following formula (1)

It is still further preferred that, in the electrophotographic photoreceptor mentioned above, the charge generation layer has a reflectivity of from 17 to 19%.

As another aspect of the present invention, an electrophotographic apparatus is provided which comprises the electrophotographic photoreceptor mentioned above, a charger configured to uniformly charge the surface of the photoreceptor, an image irradiator configured to irradiate the uniformly charged electrophotographic photoreceptor with light to form a latent electrostatic image thereon, a developing device configured to develop the latent electrostatic image with a toner, a transfer device configured to transfer the developed image to a receiving material and a cleaner configured to remove any toner remaining on the photoreceptor. In the electrophotographic apparatus, the electrophotographic photoreceptor further preferably satisfies the following relationship: 12 (V/μm)≦electric field intensity (V/D)≦35 (V/μm), wherein D (μm) represents a thickness of the charge transport layer of the electrophotographic photoreceptor and V (V) represents an absolute potential of the surface of the electrophotographic photoreceptor due to charging.

Alternatively the electrophotographic apparatus comprises an electrophotographic photoreceptor having a charge generation layer including the disazo pigment (I) and having a light transmittance of from 35 to 65% against light to form a latent electrostatic image on the electrophotographic photoreceptor.

It is more preferred that, in the electrophotographic apparatus mentioned above, the electrophotographic photoreceptor satisfies the following relationship: 15 (V/μm)≦electric field intensity (V/D)≦32 (V/μm).

It is still further preferred that electrophotographic apparatus mentioned above, the toner for use in developing the latent electrostatic image has a sphere form.

It is still further preferred that the electrophotographic apparatus mentioned above further comprises an intermediate transfer device to which multiple separate color toner images developed on the electrophotographic photoreceptor with separate color toners are transferred in a first step to form an overlaid color toner image on the intermediary transfer device while overlaying the separate color images thereon and from which the overlaid color toner image is transferred in a second step to the receiving material.

It is still further preferred that, in the alternative electrophotographic apparatus, the charge generation layer comprises a disazo pigment represented by the following formula (1).

(1)

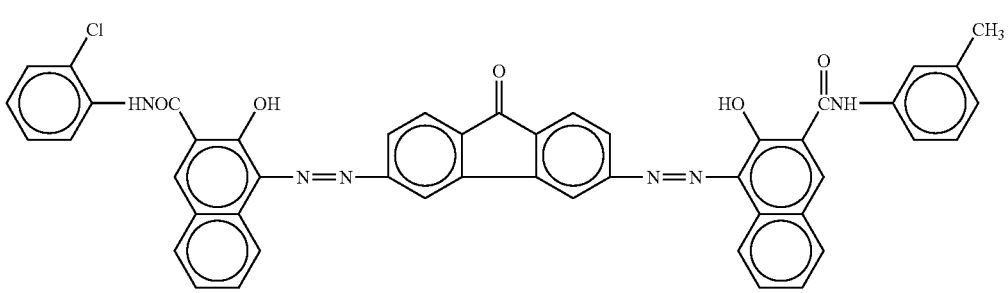

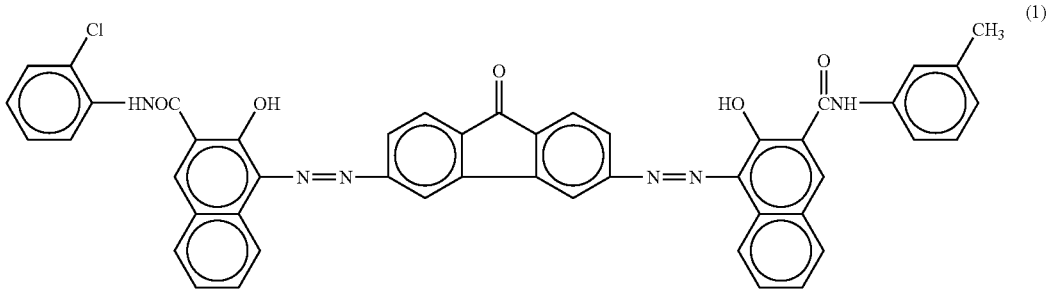

(1)

As another aspect of the present invention, a process cartridge is provided which comprises the electrophotographic photoreceptor mentioned above, optionally an image irradiator configured to irradiate the uniformly charged electrophotographic photoreceptor with light to form a latent electrostatic image thereon, and at least one of preferably all of the following devices: a charger configured to uniformly charge a surface of the electrophotographic photoreceptor; a developing device configured to develop the latent electrostatic image with a toner; a transfer device configured to transfer the developed image to a receiving material; a cleaner configured to remove any toner remaining on the electrophotographic photoreceptor; and a quencher configured to discharge the surface of the electrophotographic photoreceptor.

As another aspect of the present invention, a method of manufacturing the photoreceptor mentioned above is provided which comprises the steps of forming the conductive substrate, the undercoat layer located overlying the conductive substrate, forming a charge generation layer located overlying the undercoat layer and a charge transport layer located overlying the charge generation layer.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
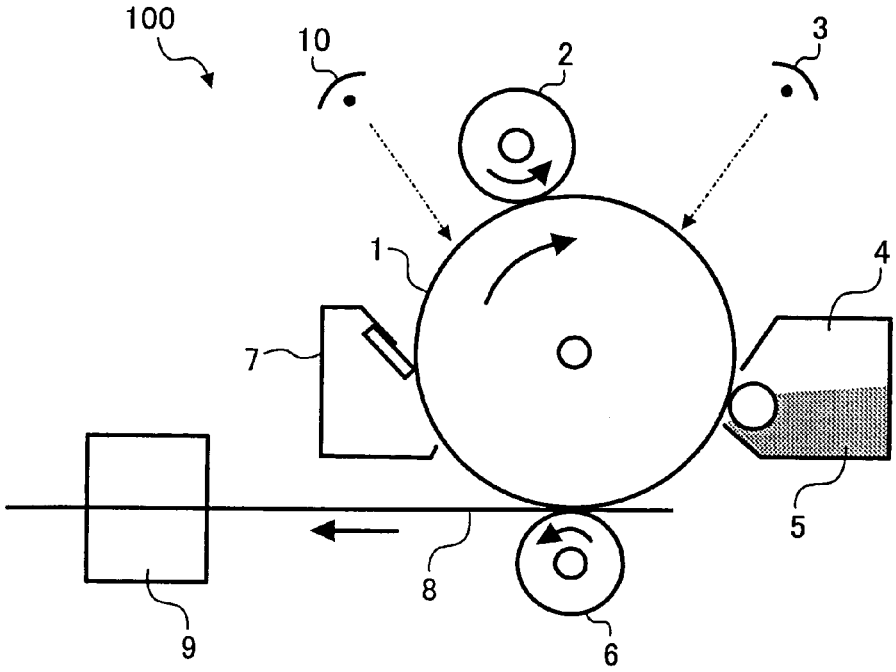
FIGS. 1 to 6 are schematic views illustrating embodiments of the electrophotographic apparatus of the present invention.

The inventors of the present invention have discovered that an electrophotographic apparatus producing a high density image with a high speed often causes the residual image problem, but occurrence of the residual images can be effectively restrained by using an electrophotgraphic photoreceptor having a specific reflectivity or a specific light transmittance in the irradiation light wavelength band of the photoreceptor. Further improvements are obtained with a specific range of electric field intensity (V/D), wherein D (μm) is a thickness of the CTL of the photoreceptor and V(V) is an absolute voltage of the surface of the photoreceptor due to charging, and even further when it comprises a disazo pigment having a specific structure.

In general, an electrophotographic photoreceptor having a multi-layer structure has side effects such as deterioration in sensitivity and voltage rise at an exposed portion when the reflectivity of the CGL against light having the highest reflectivity therefor is raised or when the light transmittance of the CGL against light having a wavelength of the image irradiation light source is lowered, namely the thickness of the CGL is thin. The reason why the wavelength having the highest reflectivity is used is that it is easy to determine and control. However, the inventors of the present invention have discovered that a disazo pigment can effectively restrain these side effects.

Azo pigments are generally prepared by reacting an aromatic diazonium salt and a coupling component (coupler) in the presence of a salt. Among various kinds of combinations, azo pigments having at least two azo groups such as disazo pigments or trisazo pigments are typically used as CGM. The structure of these azo pigments greatly affects electrostatic characteristics such as sensitivity.

For these azo pigments, naphthol based couplers are greatly preferred in terms of sensitivity. However, the sensitivity varies depending on the state of particles of an azo pigment used as CGM for an electrophotographic photoreceptor.

The disazo pigments represented by the formula (I) for use in the present invention (i.e., the disazo pigments having a coupler remaining group represented by the following formulae (II) to (VIII)) have a stable intermolecular association forming state due to the hydrogen bonding of the coupler remaining group. In addition, the particle state of the disazo pigments achieved when a layer of the disazo pigments is formed on an electrophotographic photoreceptor is extremely stable. Due to these factors, a photoreceptor comprising these disazo pigments has excellent initial sensitivity, excellent maintainabiliy and excellent light resistance. As a result, the side effects such as deterioration in sensitivity and voltage rise at an exposed portion can be restrained by improving the reflectivity against light having the highest reflectivity or the light transmittance in the irradiation light wavelength band of the photoreceptor.

(I)

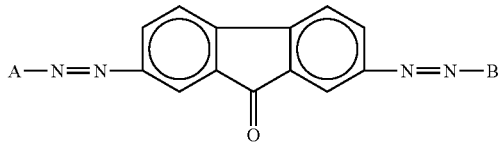

(II)

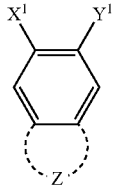

(III)

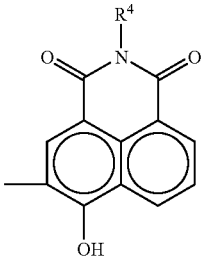

(IV)

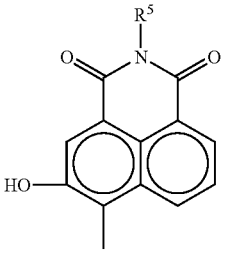

(V)

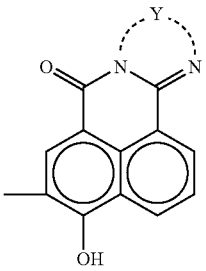

-continued (VI)

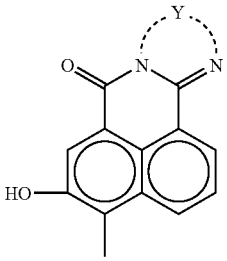

(VII)

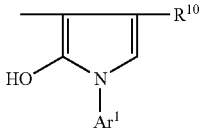

(VIII)

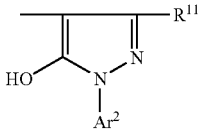

That is, to restrain the occurrence of residual images, by using a disazo pigment having a specific structure for a photoreceptor having a charge generation layer having a specific reflectivity against light having a wavelength having the highest reflectivity or a specific light transmittance in the irradiation light wavelength band and having a specific range electric field intensity (V/D), an electrophotographic apparatus capable of producing quality images at a high speed can be obtained. With regard to the reflectivity, by specifying a reflectivity of a CGL measured by a spectrophotometric calorimeter in a range of from 360 nm to 740 nm after an undercoat layer and the CGL are formed, a stable value is obtained regardless of the specification such as kind and thickness of a CTL overlaid on the CGL. In addition, before the CTL serving as outermost layer is coated, the amount of the CGL attached can be determined and thus coating conditions for the CGL can be controlled by feedback in the coating processes.

When the reflectivity against light having a wavelength showing the highest reflectivity at the CGL is too low or when the light transmittance of the CGL in the irradiation light wavelength band is too low (i.e., the thickness of the CGL is thick enough to lower the light transmittance), characteristics such as optical decay, namely, photosensitivity, are excellent in most cases but charging stability tends to be bad and deteriorates for repeated uses in a dark place. In addition, such a photoreceptor tends to be vulnerable to the reversed bias at a transfer portion. Thereby when the photoreceptor is recharged, a potential difference occurs between the portion which is irradiated by an irradiator and the portion which is not. Consequently, a residual image is obtained at a half tone portion having a dense writing.

Therefore, a photoreceptor having a high reflectivity against light having the highest reflectivity at the CGL is good or a photoreceptor having a thin CGL (i.e., the light emittance in the irradiation light wavelength band is high) is good. However, when the reflectivity or the light transmittance is too high, optical decay characteristics deteriorate and a potential at an exposed portion rises. Further, when the reflectivity or the light transmittance is high and the photoreceptor is repetitively used while the electric field intensity is high, electrostatic stresses on the photosensitive layer increase, resulting in accumulation of light fatigue. Thus residual images tend to occur in this case. It is important to control the electric field intensity within a low range.

However, when the electric field intensity is low, the electrostatic contrast obtained tends to be insufficient. Therefore, it is important that the potential at an electrophotographic photoreceptor after optical decay after irradiation sufficiently drops. However, when no suitable material is used, optical response of the photoreceptor is good but electrostatic contrast becomes insufficient, which causes a problem in image formation. As a result of the intensive study on various kinds of compounds, it has been found that the disazo pigments represented by the following formula (I) satisfies the characteristics mentioned above.

Thus the present invention was made. In addition, it pertains to a process cartridge and an electrophotographic apparatus producing full-color images using this electrophotographic mechanism capable of producing quality image without having a residual image.

The electrophotographic photoreceptor for use in the present invention is described in detail with reference to the accompanying drawings.

First, the electrophotographic apparatus is described with reference to the accompanying drawings.

FIG. 1 is a non-limiting schematic diagram illustrating an embodiment of the electrophotographic apparatus of the present invention and variations thereof described later are also within the scope of the present invention.

In FIG. 1, a photoreceptor 1 is an electrophotographic photoreceptor satisfying the requirements of the present invention.

The photoreceptor 1 has a drum form, but photoreceptors having a form such as sheet-form and endless belt-form can also be used.

Around the photoreceptor 1, a discharging lamp 10 to decrease charges remaining on the photoreceptor 1, a charger 2 configured to charge the photoreceptor 1, an imagewise light irradiator 3 configured to irradiate the photoreceptor 1 with imagewise light to form an electrostatic latent image on the photoreceptor 1, an image developing device 4 configured to develop the latent image with a toner 5 to form a toner image on the photoreceptor 1, and a cleaner 7 including a cleaning blade configured to clean the surface of the photoreceptor 1 are arranged in contact with or in close piximity to the photoreceptor 1. The toner image formed on the photoreceptor 1 is transferred on a receiving material 8 (e.g., receiving paper) by a transfer device 6. The toner image on the receiving material 8 is fixed thereon by a fixer 9.

As the charger 2, any known chargers such as corotrons, scorotrons, solid state chargers, and roller chargers can be used. Among the chargers, contact chargers and short-range chargers are preferably used in terms of power consumption. Particularly, short-range chargers which can charge a photoreceptor while a proper gap is formed between the chargers and the surface of the photoreceptor are more preferably used.

As the transfer device 6, the above-mentioned known chargers can be used. Among the chargers, a combination of a transfer charger and a separating charger is preferably used.

Suitable light sources for use in the imagewise light irradiator 3 and the discharging lamp 10 comprise fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wavelength range, filters such as sharp-cut filters, band pass filters, near-infrared cutting filters, dichroic filters, interference filters, color temperature converting filters and the like can be used.

When the toner image formed on the photoreceptor 1 by the image developing device 4 is transferred onto the receiving paper 8, not all of the toner images is transferred on the receiving paper 8, and toner particles remain on the surface of the photoreceptor 1. The residual toner is removed from the photoreceptor 1 by the cleaner 7. Suitable cleaners for use as the cleaner 7 comprise cleaning blades made of a rubber, fur brushes and mag-fur brushes.

When the photoreceptor 1 which is previously charged positively (or negatively) is exposed to imagewise light, an electrostatic latent image having a positive (or negative) charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversed image) can be obtained. As the developing method, known developing methods can be used. In addition, as the discharging methods, known discharging methods can also be used.

Figure 2:
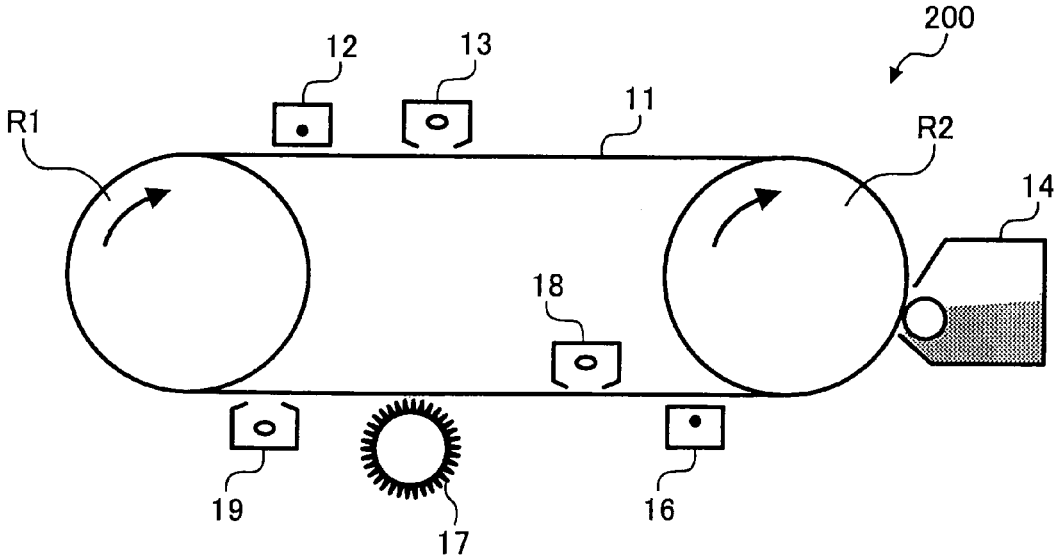

FIG. 2 is a schematic view illustrating another embodiment of electrophotographic process of the present invention. The photoreceptor 1 is an electrophotographic photoreceptor satisfying the requirements of the present invention and has a belt form. The belt-form photoreceptor 11 is rotated by rollers R1 and R2. The photoreceptor 11 is charged with a charger 12, and then exposed to imagewise light emitted by an imagewise light irradiator 13 to form an electrostatic latent image on the photoreceptor 11. The latent image is developed with an image developing device 14 to form a toner image on the photoreceptor 11. The toner image is transferred onto a receiving paper (not shown) using a transfer device 16. After the toner image transferring process, the surface of the photoreceptor 11 is cleaned with a cleaning brush 17 after performing a pre-cleaning light irradiating operation using a pre-cleaning light irradiator 18. Then the photoreceptor 11 is exposed to light emitted by a discharging light source 19 to reduce the charge remaining thereon. In the pre-cleaning light irradiating process, light irradiates the photoreceptor 11 from the side of the substrate thereof. In this case, the substrate has to be light-transmissive.

The elecctrophotographic processes for use in the present invention is not limited to the processes shown in FIGS. 1 and 2. For example, in FIG. 2, the pre-cleaning light irradiating operation can be performed from the photosensitive layer side of the photoreceptor 11. In addition, the light irradiation in the imagewise light irradiating process and the discharging process may be performed from the substrate side of the photoreceptor 11.

Further, a pre-transfer light irradiation operation, which is performed before transferring the toner image, and a preliminary light irradiation operation, which is performed before the imagewise light irradiation, and other light irradiation operations may also be performed.

The above-mentioned image forming unit may be fixedly set in an electrophotographic apparatus such as copiers, facsimile machines and printers. However, the image forming unit can be set therein as a process cartridge. The process cartridge means an image forming unit which comprises a photoreceptor and at least one or more or all of a charger, an imagewise light irradiator, an image developing device, a transfer device, a cleaner, and a queencher.

Various types of process cartridges can be used in the present invention. An embodiment of the process cartridge of the present invention is illustrated in FIG. 3.

Figure 3:
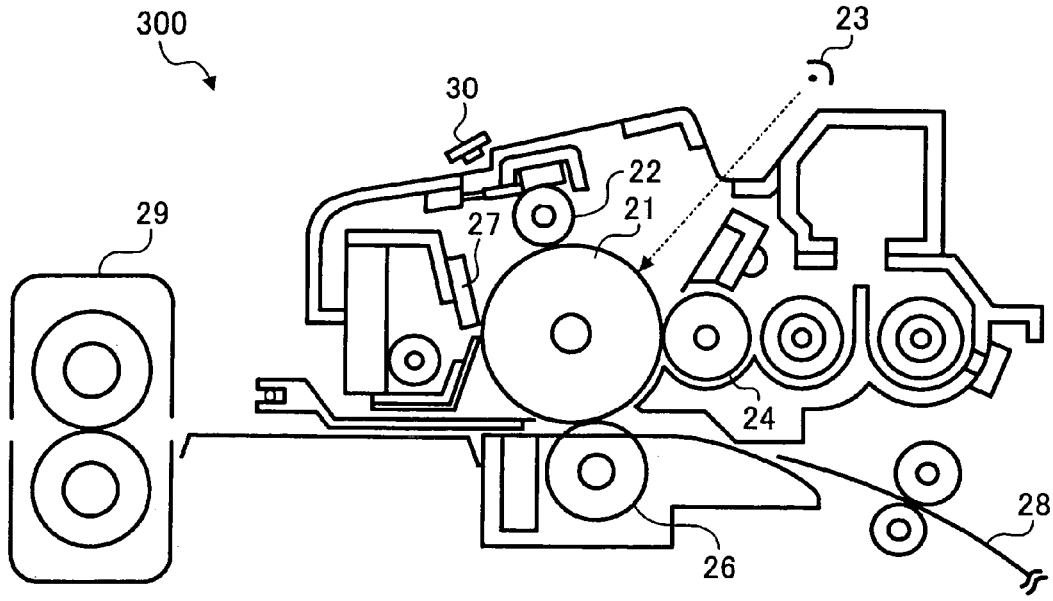

In FIG. 3, the process cartridge comprises a photoreceptor 21, which is the photoreceptor of the present invention, a charger 22 configured to charge the photoreceptor 21, an image developing device (a developing roller) 24 configured to develop an electrostatic latent image, which is formed on the photoreceptor by an imagewise light irradiator 23, with a toner to form a toner image, a transfer device 26 configured to transfer the toner image to a receiving material 28, and a cleaning blade 27 configured to clean the surface of the photoreceptor 21. Numerals 29 and 30 denote a fixer and a quencher, respectively. The photoreceptor 21 has a drum form, but photoreceptors having a form such as sheet-form and endless belt-form can also be used.

Figure 4:
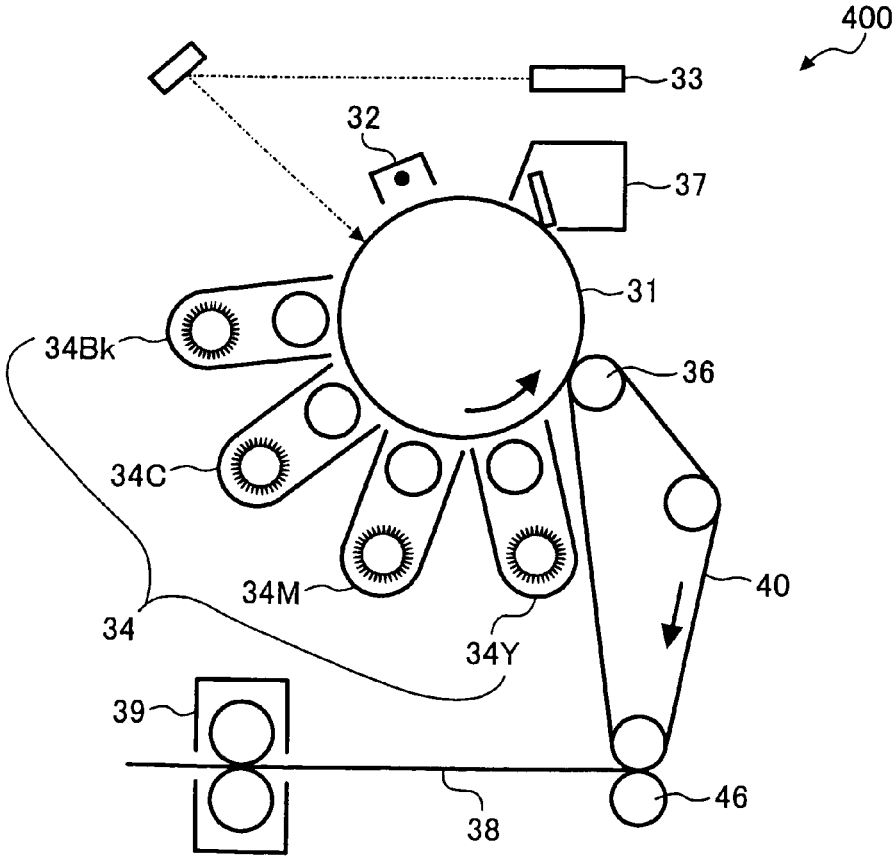

FIG. 4 illustrates another embodiment of the electrophotographic apparatus of the present invention. With reference to FIG. 4, the electrophotographic apparatus has a photoreceptor 31 which is the photoreceptor of the present invention. Around the photoreceptor 31, a charger 32, an imagewise light irradiator 33, an image developing unit 34 having a black image developing device 34Bk, a cyan image developing device 34C, a magenta image developing device 34M and a yellow image developing device 34Y, an intermediate transfer belt 40 serving as an intermediate transfer medium, and a cleaner 37 are arranged.

The image developing devices 34Bk, 34C, 34M and 34Y can be independently controlled, and each of the image developing devices is independently driven when desired. Toner images formed on the photoreceptor 31 are transferred onto the intermediate transfer belt 40 by a first transfer device 36. The intermediate transfer belt 40 is brought into contact with the photoreceptor 31 by the first transfer device 36 only when a toner image on the photoreceptor 31 is transferred thereto. The toner images overlaid on the intermediate transfer belt 40 are transferred onto a receiving material 38 by a second transfer device 46, and the toner images are fixed on the receiving material 38 by a fixer 39. The second transfer device 46 is brought into contact with the intermediate transfer belt 40 only when the transfer operation is performed.

In an electrophotographic apparatus having a drum-form transfer device, color toner images are transferred onto a receiving material electrostatically attached to the transfer drum. Therefore, an image cannot be formed on a thick paper. However, in the electrophotographic apparatus as illustrated in FIG. 4, each toner image is formed on the intermediate transfer belt and the overlaid toner images are transferred onto a receiving material. Therefore, an image can be formed on any kinds of receiving materials. The image forming method using an intermediate transfer medium can be applied to the electrophotographic apparatus as illustrated in FIGS. 1-3, and 5 as well as the electrophotographic apparatus illustrated in FIGS. 4 and 6.

Figure 5:
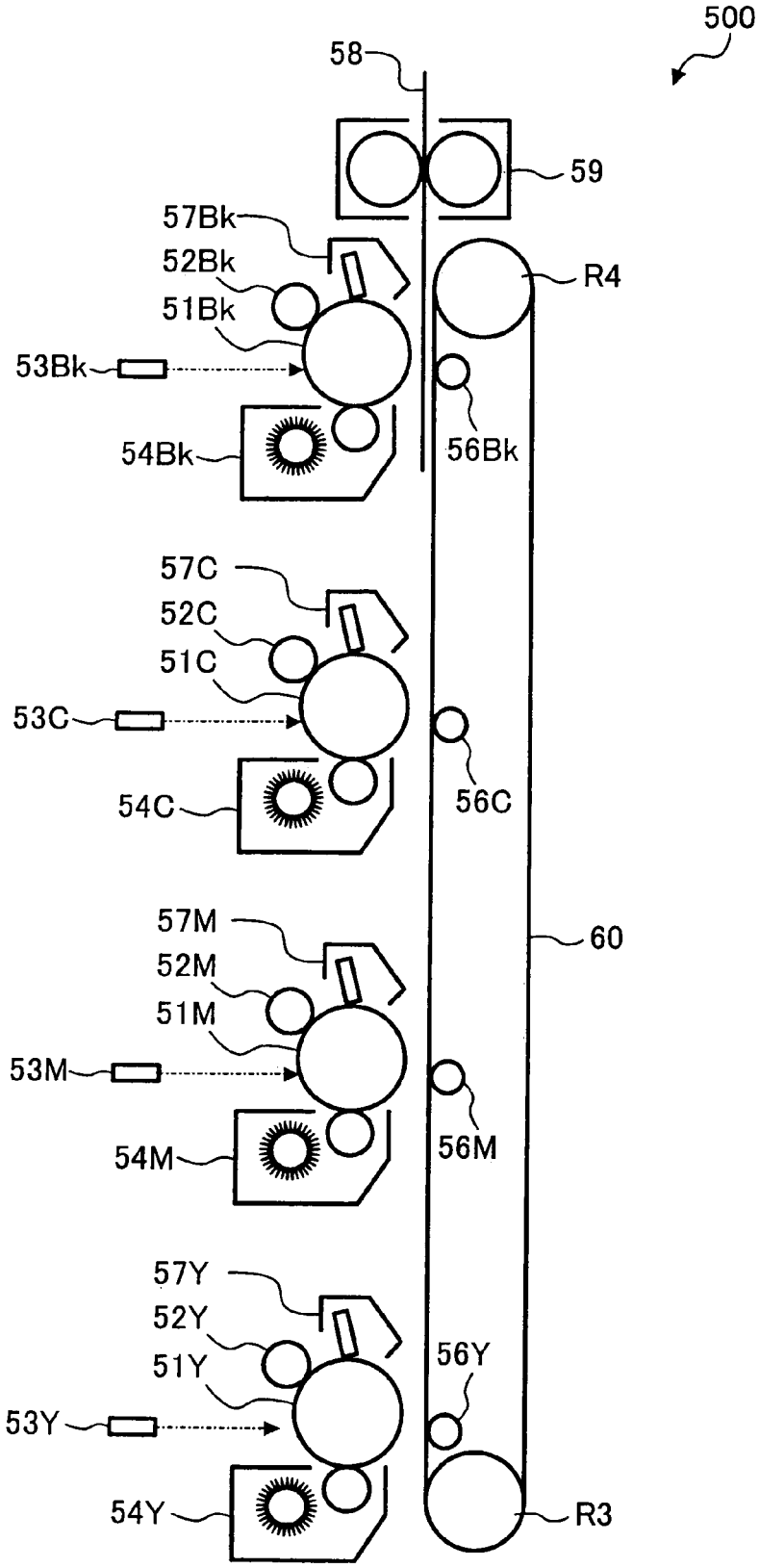

FIG. 5 illustrates another embodiment of the electrophotographic apparatus of the present invention.

The electrophotographic apparatus has four color image forming sections, i.e., yellow, magenta, cyan and black image forming sections. The image forming sections comprise respective photoreceptors 51Y, 51M, 51C and 51Bk. The photoreceptors 51 for use in the electrophotographic apparatus satisfy the requirements of the present invention.

Around each of the photoreceptors (51Y, 51M, 51C or 51Bk), a charger (52Y, 52M, 52C or 52Bk), an imagewise light irradiator (53Y, 53M, 53C or 53Bk), an image developing device (54Y, 54M, 54C or 54Bk), and a cleaner (57Y, 57M, 57C or 57Bk) are arranged. In addition, a feed/transfer belt 60, which is arranged below the image forming sections, is tightly stretched by rollers R3 and R4. The feed/transfer belt 60 is attached to or detached from the photoreceptors 51 by transfer devices 56Y, 56M, 56C and 56Bk to transfer toner images from the photoreceptors 51 to a receiving material 58. The resultant color toner image is fixed by a fixer 59.

The tandem-type electrophotographic apparatus illustrated in FIG. 5 has a plurality of photoreceptors 51 for forming four color images, and color toner images which can be formed in parallel can be transferred onto the receiving material 58. Therefore, the electrophotographic apparatus can form full color images at a much higher speed than that of such an electrophotographic apparatus as illustrated in FIG. 4.

Figure 6:
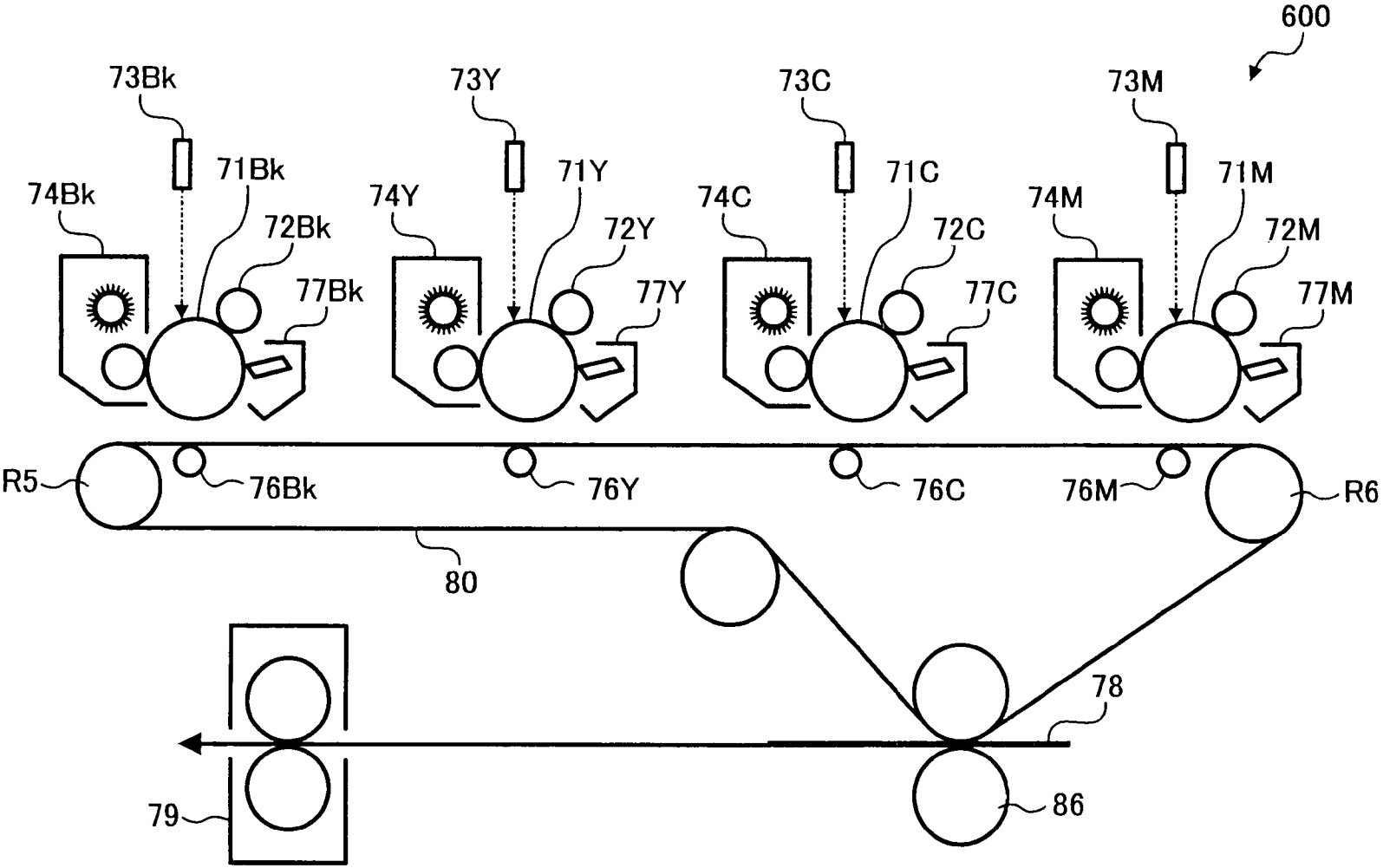

FIG. 6 illustrates another embodiment of the electrophotographic apparatus of the present invention, which is a tandem-type color electrophotographic apparatus having an intermediate transfer medium.

The electrophotographic apparatus has four color image forming sections, i.e., yellow, magenta, cyan and black image forming sections. The image forming sections comprise respective photoreceptors 71Y, 71M, 71C and 71Bk. The photoreceptors 71 for use in the electrophotographic apparatus satisfy the requirements of the present invention.

Around each of the photoreceptors (71Y, 71M, 71C or 71Bk), a charger (72Y, 72M, 72C or 72Bk), an imagewise light irradiator (73Y, 73M, 73C or 73Bk), an image developing device (74Y, 74M, 74C or 74Bk); and a cleaner (77Y, 77M, 77C or 77Bk) are arranged. In addition, an intermediate transfer belt 80, which is arranged below the image forming sections, is tightly stretched by rollers R5 and R6 and other rollers. The intermediate transfer belt 80 is attached to or detached from the photoreceptors by transfer devices 76Y, 76M, 76C and 76Bk to receive toner images from the photoreceptors. The color toner images formed on the intermediate transfer belt 80 are transferred onto a receiving material 78 at once by a transfer device 86. Then the color toner images are fixed by a fixer 79.

Next, the organic photoreceptor of the present invention will be explained in detail referring to drawings.

Figure 7:
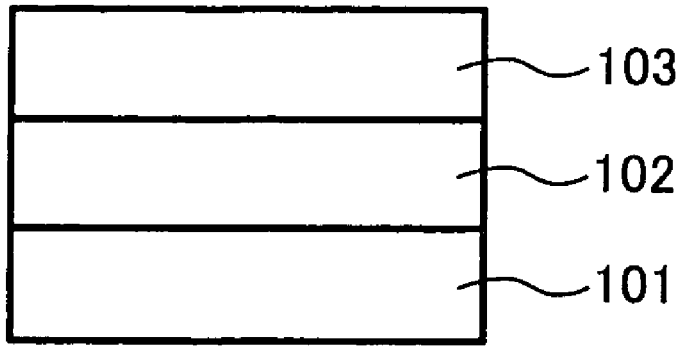
FIGS. 7 and 8 are schematic view illustrating the cross sections of embodiments of the photoreceptor of the present invention.

FIG. 7 illustrates a schematic cross section of an embodiment of the photoreceptor having the layer structure of the present invention. The photoreceptor has an electroconductive substrate 101, a charge generation layer (CGL) 102 and a charge transport layer (CTL) 103.

Figure 8:
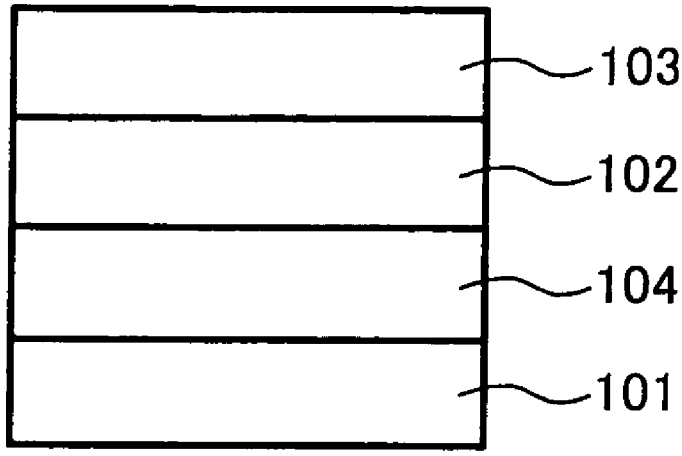
Figure 9:
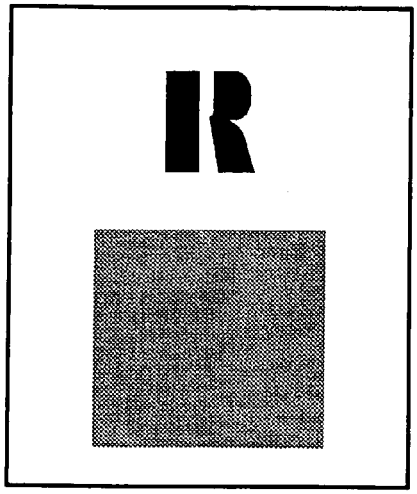
FIGS. 9 to 11 are schematic views for explaining the residual image problem.
Figure 10:
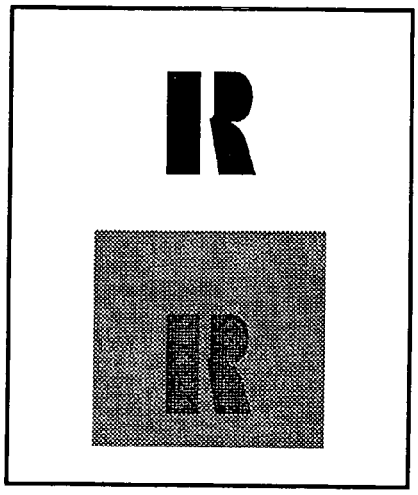
Figure 11:
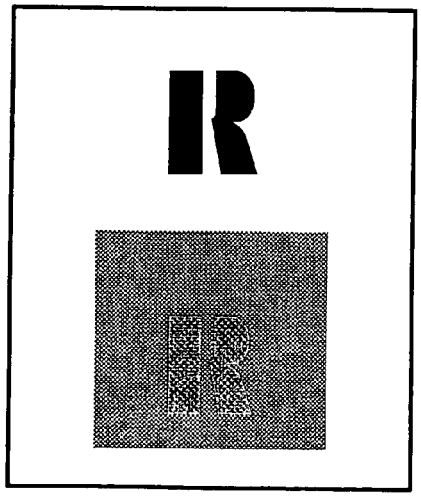
Figure 12A:
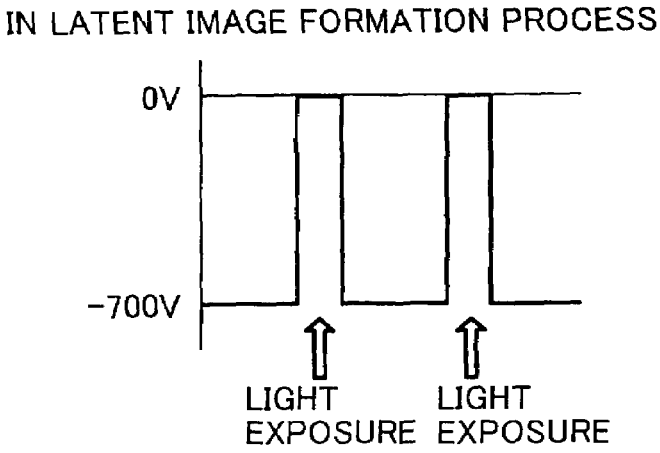
FIGS. 12A to 12C are schematic views helping explain the change of the potential of a photoreceptor during the image forming processes.
Figure 12B:
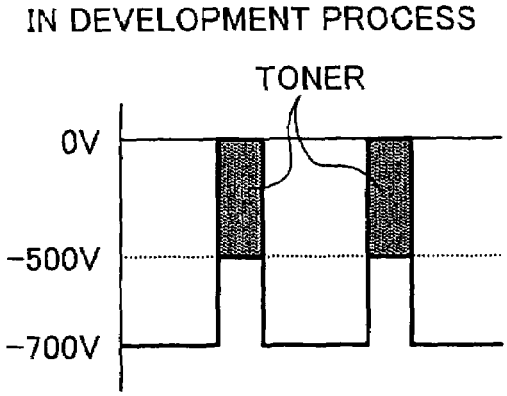
Figure 12C:
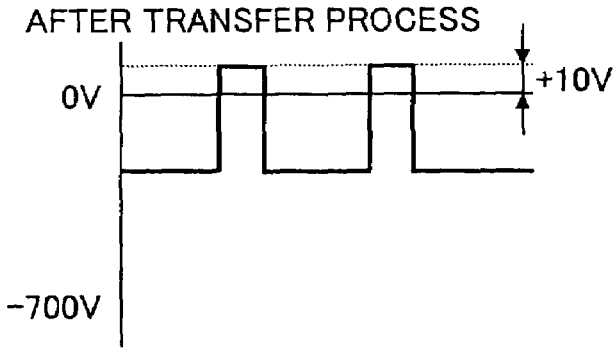

FIG. 8 illustrates a schematic cross section of another embodiment of the photoreceptor having the layer structure of the present invention. The photoreceptor has a structure such that an undercoat layer 104 is formed between the substrate 101 and the CGL 102 of FIG. 7.

Suitable materials for use as the electroconductive substrate 101 comprise materials having a volume resistance not greater than $10^{10}$ Ω·cm. Specific examples of such materials comprise plastic or paper cylinders or films, on the surface of which a metal such as aluminum, nickel, chromium, nichrome, copper, gold, silver, platinum, iron and the like, or a metal oxide such as tin oxides, indium oxides and the like, is formed by a method such as vapor deposition and sputtering. In addition, a plate of a metal such as aluminum, aluminum alloys, nickel and stainless steel can be used. A metal cylinder can also be used as the substrate 101, which is prepared by tubing a metal such as aluminum, aluminum alloys, nickel and stainless steel by a method such as drawing, impact molding, extrusion molding, extrusion drawing or cutting, and then subjecting the surface of the tube to cutting, super finishing, polishing and the like treatments.

The photosensitive layer of the present invention is a multi-layered photosensitive layer overlying the undercoat layer 104. The multi-layered photosensitive layer comprising the CGL 102 overlying the electroconductive substrate 101 and the CTL 103 overlying the CGL 102. "Overlying" means "located above, including in contact with, but not requiring contact". The structures of each layer of this multi-layered photosensitive layer are now described.

(CGL)

The CGL 102 comprises a CGM as a main component, and optionally comprises a binder resin. As CGMs for use in the present invention, considering the characteristics mentioned above, at least one of the main components is a disazo pigment represented by formula (I) described before. Specific examples of such disazo pigments comprise a compound having a benzene ring substituent having Cl at the ortho position at each end of the compound such as (2,7-bis[3-(2-chlorophenyl)carbamoyl-2-hydroxy-1-naphthylazo]-9-fluorenone. Specific suitably preferred examples among the compounds represented by formula (I) is a disazo pigment having the structure represented by the following formula (1).

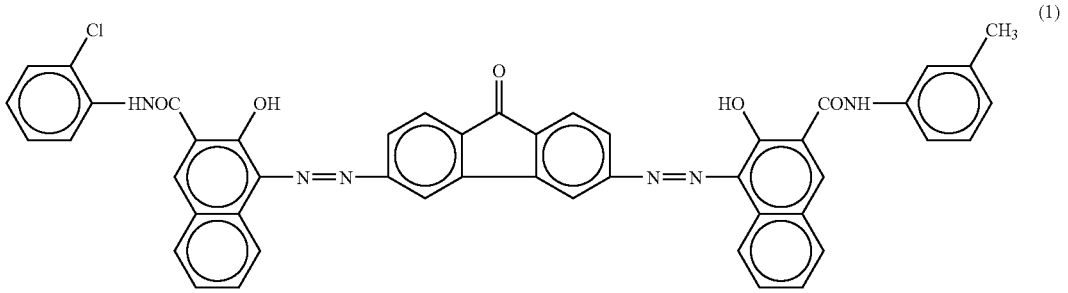

(1)

These CGMs can be used alone or in combination.

Suitable binder resins, which are optionally included in the CGL, at least include polyamide, polyurethane, epoxy resins, polyketone, polycarbonate, polyarylate, silicone resins, acrylic resins, polyvinyl butyral, polyvinyl formal, polyvinyl ketone, polystyrene, poly-N-vinylcarbazole, polyacrylamide, and the like resins.

These resins can be used alone or in combination.

In addition, charge transport polymers can be used as the binder resin of the CGL. Further, low molecular weight CTMs can be added to the CGL if desired.

The CTMs are classified into positive-hole transport materials and electron transport materials and further classified into low molecular weight CTMs and charge transport polymers.

Specific examples of the electron transport materials at least include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiophene-5,5-dioxide, and the like.

These electron transport materials can be used alone or in combination.

Specific examples of the positive-hole transport materials at least include oxazole derivatives, oxadiazole derivatives, imidazole derivatives, triphenyl amine derivatives, 9-(p-diethylaminostyrylanthracene), 1,1-bis-(4-dibenzylaminophenyl)propane, styryl anthracene, styryl pyrazoline, phenyl hydrazone, α-phenyl stilbene derivatives, thiazole derivatives, triazole derivatives, phenazine derivatives, acridine derivatives, benzofuran derivatives, benzimidazole derivatives, thiophene derivatives, etc.

The positive-hole transport materials can be used alone or in combination.

Suitably preferred methods for forming the CGL include casting methods from a solution dispersion system.

The casting methods for forming the CGL typically include the following steps:

(1) preparing a coating liquid by mixing the CGMs mentioned above with a solvent such as tetrahydrofuran, cyclohexanone, dioxane, dichloroethane, butanone and the like, optionally together with a binder resin and an additive, and then dispersing the materials with a ball mill, an attritor, a sand mill or the like, to prepare a CGL coating liquid;

(2) coating the CGL coating liquid, which is diluted if necessary, on a substrate by a method such as dip coating, spray coating and bead coating; and (3) drying the coated liquid to form a CGL.

The thickness of the CGL formed as mentioned above satisfies the following conditions: the reflectivity of the CGL against light having a wavelength showing the highest reflectivity therefor when measured by a spectrophotometric calorimeter in the range of from 360 nm to 740 nm after an undercoat layer and the CGL are formed is from 15 to 21% and preferably from 17 to 19%; and/or light transmittance of the CGL against light having a wavelength used in the image irradiation is from 35 to 65% and preferably from 40 to 55%. When the light transmittance is too low (i.e., the CGL is formed thick enough to reduce the light transmittance), characteristics such as optical decay, namely, photosensitivity, are excellent in most cases but charging stability tends to be bad and therefore deteriorates for repeated uses in a dark place. In addition, such a photoreceptor tends to be vulnerable to reversed bias at a transfer portion. Thereby when the photoreceptor is recharged, a potential difference occurs between the portion which is irradiated by an irradiator and the portion which is not. Consequently, a residual image is obtained at a half tone portion having a dense writing.

Therefore, it is good to reduce the amount of the CGL attached, namely, to have an undercoat layer and a CGL having a high reflectivity against light having a wavelength showing the highest reflectivity at the CGL and/or to have a thin CGL (i.e., the light transmittance in the wavelength band of the irradiation light is high). However, when the reflectivity and/or light transmittance is too high, optical decay characteristics deteriorate and a potential at an exposed portion rises.

(CTL)

Next, the CTL 103 is now described.

The CTL 103 is typically prepared by preparing a CTL coating liquid in which a mixture of a CTM and a binder resin or a charge transport polymer material is dissolved or dispersed in a solvent, and then coating the coating liquid followed by drying.

Specific examples of the polymers for use as the binder resin of the CTL include thermoplastic resins and thermosetting resins such as polystyrene, styrene/acrylonitrile copolymers, styrene/butadiene copolymers, styrene/maleic anhydride copolymers, polyester, polyvinyl chloride, vinyl chloride/vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins, but are not limited thereto.

These polymer materials can be used alone or in combination. In addition, copolymers of the monomers of the polymer materials mentioned above can also be used. Further, copolymers of the monomers with a CTM can also be used.

When an electrically inactive polymer is used in order to impart good stability to withstand environmental conditions to the resultant photoreceptor, resins such as polyester, polycarbonate, acrylic resins, polystyrene, polyvinylidene chloride, polyethylene, polypropylene, fluorine-containing resins, polyacrylonitrile, acrylonitrile/styrene/butadiene copolymers, acrylonitrile/styrene copolymers and ethylene/vinyl acetate copolymers are preferably used. Electrically inactive charge transport polymer materials mean polymers which do not have a structure having a photoconductive property, such as the triarylamine structure.

When these resins are used as an additive together with a binder resin, the content thereof is preferably not greater than 50% by weight of the sum of additive and binder in view of photosensitivity of the resultant photoreceptor.

Specific examples of the CTMs for use in the CTL include the low molecular weight electron transport materials, low molecular weight positive hole transport materials, and charge transport polymer materials mentioned above.

When a low molecular weight CTM is used, the content thereof is from 40 to 200 parts by weight, and preferably from 70 to 150 parts by weight, per 100 parts by weight of the resin components included therein. When a charge transport polymer is used, the content thereof is from 0 to 500 parts by weight, and preferably from 0 to 150 parts by weight, per 100 parts by weight of the charge transport components included therein.

When two or more kinds of CTMs are included in the CTL, the difference in ionization potential between the two or more kinds of CTMs is as small as possible, specifically the difference is preferably not greater than 0.15 eV. In this case, it is prevented that one of the CTMs serves as a trap of the other CTMs.

In order to impart high photosensitivity to a photoreceptor, the content of the CTMs in the CTL is preferably not less than 70 parts by weight per 100 parts by weight of the resin components in the CTL.

Suitable solvents for use in the CTL coating liquid include ketone such as methyl ethyl ketone, acetone, methyl isobutyl ketone, and cyclohexanone; ethers such as dioxane, tetrahydrofuran, and ethyl cellosolve; aromatic solvents such as toluene, and xylene; halogen-containing solvents such as chlorobenzene, and dichloromethane; esters such as ethyl acetate and butyl acetate; etc. These solvents can be used alone or in combination.

The CTL can include one or more additives such as antioxidants, plasticizers, lubricants and ultraviolet absorbents, if desired. Specific examples thereof are mentioned below. These additives are added in the CTL in an amount of from 0.1 to 50 parts by weight, preferably from 0.1 to 20 parts by weight, per 100 parts by weight of the resin components therein. The leveling agents are added in an amount of from 0.001 to 5 parts by weight per 100 parts by weight of the resin components therein.

Suitable coating methods for use in coating the CTL coating liquid include dip coating methods, spray coating methods, ring coating methods, roll coating methods, gravure coating methods, nozzle coating methods, screen coating methods, etc. Among them, the spray coating methods are preferred since agglomeration of fillers can be easily prevented.

The thickness of the CTL is generally from 15 to 40 μm, and preferably from 15 to 30 μm. When it is desired to form images having good resolution, the thickness of the CTL is preferably not greater than 25 μm. It is also necessary to consider the electric field intensity of an electrophotographic apparatus. The electric field intensity is a value of V/D, wherein D (μm) represents a thickness of the CTL of the photoreceptor and V (V) represents an absolute potential of the surface of the photoreceptor due to the charging. The electric field intensity is from 12 (V/μm) to 35 (V/μm) as mentioned above, and preferably from 15 to 32 (V/μm).

Further, when the electric field intensity is high, electrostatic stresses on the photosensitive layer increase, resulting in increase of light fatigue. Thus when the electric field intensity is low, electrostatic contrast obtained tends to be insufficient. Therefore, it is important to have a potential suitable for the thickness of the CGL used.

(Undercoat Layer)

In the photoreceptor of the present invention, an undercoat layer 104 can be formed between the substrate 101 and the CGL 102 to improve adhesion between the substrate and the photosensitive layer; to prevent formation of moiré; to improve the coating property of the overlying layer; to reduce the residual potential; and to prevent injection of charges from the substrate into the photosensitive layer.

The undercoat layer typically includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide.

The undercoat layer can also be formed by coating a coating liquid using a proper solvent and a proper coating method mentioned above for use in the photosensitive layer.

In addition, metal oxide layers formed by a sol-gel method using a silane coupling agent, titanium coupling agent or a chromium coupling agent can also be used as the undercoat layer.

Further, a layer of aluminum oxide which is formed by an anodic oxidation method and a layer of an organic compound such as polyparaxylylene or an inorganic compound such as $SiO_2$, $SnO_2$, $TiO_2$, ITO or $CeO_2$ which is formed by a vacuum evaporation method is also preferably used as the undercoat layer.

The thickness of the undercoat layer is preferably suitably from 0.1 to 10 μm and preferably from 1 to 5 μm.

In the photoreceptor of the present invention, one or more additives such as antioxidants, plasticizers, ultraviolet absorbents, low molecular weight charge transport materials and leveling agents can be used in one or more layers of the photosensitive layer, i.e., CGL, CTL, and undercoat layer, to improve the gas barrier property of the outermost layer of the photoreceptor and the stability thereof to withstand environmental conditions.

The following is typical materials for these compounds.

(Antioxidant)

Suitable antioxidants for use in the layers of the photoreceptor include the following compounds but are not limited thereto.

(a) Phenolic Compounds 2,6-di-t-butyl-p-cresol, 2,4,6-tri-t-butylphenol, n-octadecyl-3-(4'-hydroxy-3',5'-di-t-butylphenol)propionate, styrenated phenol, 4-hydroxymethyl-2,6-di-t-butylphenol, 2,5-di-t-butylhydroquinone, cyclohexyl phenol, butylhydroxyanisole, 2,2'-methylene-bis-(4-ethyl-6-t-butylphenol), 4,4'-isopropylidenebisphenol, 1,1-bis(4-hydroxyphenyl)cyclohexane, 4,4'-methylene-bis(2,6-di-t-butylphenol), 2,6-bis(2'-hydroxy-3'-t-butyl-5'-methylbenzyl)-4-methylphenol, 1,1,3-tris-(2-methyl-4-hydroxy-5-t-butylphenyl)butane, 1,3,5-trismethyl-2,4,6-tris(3,5-di-t-butyl-4-hydroxybenzyl)benzene, tetrakis-[methylene-3-(3',5'-di-t-butyl-4-hydroxyphenyl)propionate]methane, tris(3,5-di-t-butyl-4-hydroxyphenyl)isocyanate, tris[β-(3,5-di-t-butyl-4-hydroxyphenyl)propionyl-oxyethyl]isocyanate, e, 4,4'-thiobis(4-methyl-6-t-butylphenol), 4,4'-thiobis(4-methyl-6-t-butylphenol) etc.

(b) Amine Compounds phenyl-α-naphthylamine, phenyl-β-naphthylamine, N,N'-diphenyl-p-phenylenediamine, N,N'-di-β-naphthyl-p-phenylenediamine, N-cyclohexyl-N'-phenyl-p-phenylenediamine, N-phenylene-N'-isopropyl-p-phenylenediamine, aldol-α-naphthylamine, 6-ethoxy-2,2,4-trimethyl-1,2-dihydroquinoline, etc.

(c) Sulfur-Containing Compounds thiobis(β-naphthol), thiobis(N-phenyl-β-naphthylamine), 2-mercaptobenzothiazole, 2-mercaptobenzimidazole, dodecylmercaptan, tetramethylthirammonosulfide, tetramethylthiramdisulfide, nickeldibutylthiocarbamate, isopropylxanthate, dilaurylthiodipropionate, distearylthiodipropionate, etc.

(d) Phosphorus-Containing Compounds triphenyl phosphite, diphenyldecyl phosphite, phenyl isodecyl phosphite, tri(nonylphenyl)phosphite, 4,4'-butylidene-bis(3-methyl-6-t-butylphenyl-ditridecylphosphite), distearyl-pentaerythritol diphosphite, trilauryl trithiophosphite, etc.

(Plasticizer)

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate esters, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-Containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

(Ultraviolet Absorbing Agent)

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenylester of 3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy) acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]un decane-2,4-dione, 4-benzoyloxy-2,2,6,6-tetramethylpiperidine, and the like.

The low molecular weight CTMs mentioned above for use in the CGL 102 can also be used in each layer of the photoreceptor of the present invention.

EXAMPLES

Example 1

<Formation of Photoreceptor>

An undercoat layer coating liquid, a CGL coating liquid and a CTL coating liquid having the following compositions were prepared.

Undercoat Layer Coating Liquid

| | |
|---|---|
| Alkyd resin (BEKKOZOL M-6301-45 from Dainippon Ink & Chemicals, Inc.) | 9 parts |
| Melamine resin (SUPER BEKKAMIN G-821-60 from Dainippon Ink & Chemicals, Inc.) | 7 parts |
| Titanium dioxide (CR-EL from Ishihara Sangyo Kaisha Ltd.) | 40 parts |
| Methyl ethyl ketone | 150 parts |

CGL Coating Liquid

Disazo pigment having the following formula (M) 5.2 parts

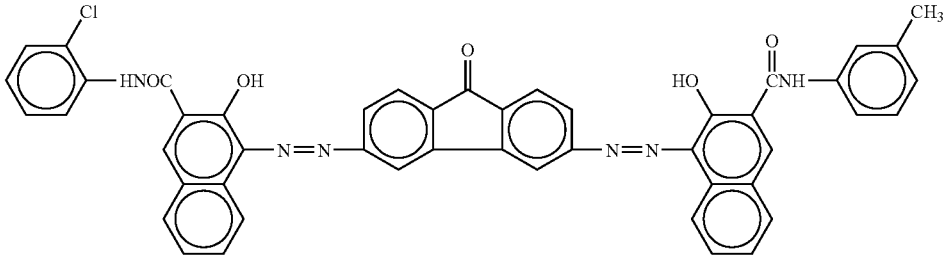

| | |
|---|---|
| Polyvinyl butyral (XYHL from Union Carbide Corp.) | 0.25 parts |
| Cyclohexanone | 200 parts |
| Methyl ethyl ketone | 80 parts |

CTL Coating Liquid

| | |
|---|---|
| CTM having the following formula: | 7 parts |

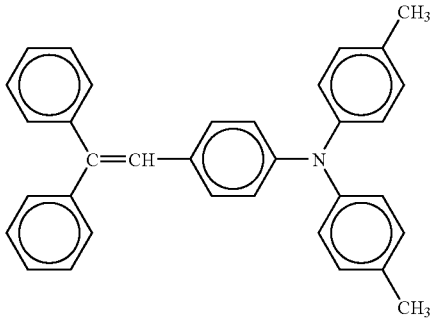

| | |
|---|---|
| Z-form polycarbonate resin (viscosity average molecular weight of 52,000, from Teijin Chemicals Ltd.) | 10 parts |
| Tetrahydrofuran | 85 parts |
| 1% tetrahydrofuran solution of silicone oil (silicone oil: KF50-100CS from Shin-Etsu Chemical Industry Co., Ltd.) | 1 part |

On an aluminum cylinder with a diameter of 30 mm, the undercoat layer coating liquid, the CGL coating liquid and the CTL coating liquid mentioned above were coated and formed accordingly by a dip coating method and then dried.

The elevating speed was controlled such that the undercoat layer was formed to have a thickness of 4.5 μm, the CGL was formed such that the reflectivity of the undercoat layer and the CGL for a wavelength of 720 nm, which is the highest wavelength for the undercoat layer and the charge generation layer in the range of from 360 nm to 740 nm when measured by spectrophotometric calorimeter (SPECTROPHOTOMETER CM-2500D manufactured by KONICA Minolta Holdings Inc.), was 17.5% and the CTL was formed to have a thickness of 31 μm.

<Evaluation>

The thus prepared photoreceptor was finished for practical use and then set in an electrophotographic apparatus remodeled based on IPSIO COLOR 8100 (manufactured by Ricoh Co., Ltd.) having a LD writing wavelength 655 nm to perform a running test in which 30,000 copies of an image containing a rectangular solid image and characters were produced with an image area proportion of 5%. Thus Examples 1 to 4 and Comparative Examples 1 to 4 were performed.

The toner used had an average particle diameter of 5.9 μm.

The charger used in the electorphotographic apparatus was a short-range charging roller of the photoreceptor.

The charging conditions were as follows:

Voltage of AC component: 1.9 kV (peak to peak voltage)

Frequency of AC component: 1.35 kHz

Voltage of DC component: DC voltage was controlled such that the potential of the charged photoreceptor was kept at −500 V during the running test. No quencher was provided to this electrophotographic device.

In addition, other conditions were as follows.

Development bias: −350 V

Environmental conditions: 24° C. 54% RH.

When the running test was complete, residual images and other image qualities were evaluated.

The produced images were visually observed to determine whether the images have a residual image. The images were graded as follows.

Rank 5: No residual image observed. Excellent

Rank 4: A very minor degree of residual image observed. Almost Excellent.

Rank 3: A minor degree of residual image observed. Practically good.

Rank 2: Some degree of residual image observed. Practically no problem.

Rank 1: Considerable residual image observed and recognized as problematic. Bad.

Other image qualities evaluated were background fouling, image density, etc.

The evaluation results are shown in Table 1.

Example 2

The electrophotographic photoreceptor of Example 2 was prepared in the same manner as in Example 1 except that the CTL was formed to have a thickness of 20 μm.

The thus prepared electrophotographic photoreceptor was evaluated in the same way as in Example 1.

The evaluation results are shown in Table 1.

Example 3

The electrophotographic photoreceptor of Example 3 was prepared in the same manner as in Example 1 except that the CTL was formed to have a thickness of 33 μm.

The thus prepared electrophotographic photoreceptor was evaluated in the same way as in Example 1.

The evaluation results are shown in Table 1.

Example 4

The electrophotographic photoreceptor of Example 4 was prepared in the same manner as in Example 1 except that the CTL was formed to have a thickness of 16 μm.

The thus prepared electrophotographic photoreceptor was evaluated in the same way as in Example 1.

The evaluation results are shown in Table 1.

Example 5

The electrophotographic photoreceptor of Example 5 was prepared in the same manner as in Example 1 except that the reflectivity of the undercoat layer and the CGL for a wavelength of 720 nm by the spectrophotometric colorimeter was 18.5%.

Example 6

The electrophotographic photoreceptor of Example 6 was prepared in the same manner as in Example 1 except that the reflectivity of the undercoat layer and the CGL for a wavelength of 720 nm by the spectrophotometric calorimeter was 16.7%.

Example 7

The electrophotographic photoreceptor of Example 7 was prepared in the same manner as in Example 1 except that the reflectivity of the undercoat layer and the CGL for a wavelength of 720 nm by the spectrophotometric calorimeter was 19.4%.

Example 8

The electrophotographic photoreceptor of Example 6 was prepared in the same manner as in Example 1 except that the reflectivity of the undercoat layer and the CGL for a wavelength of 720 nm by the spectrophotometric calorimeter was 20.5%.

Comparative Example 1

The electrophotographic photoreceptor of Comparative Example 1 was prepared in the same manner as in Example 1 except that 4 parts by weight of Y form titanyl phtalocyanine was used in place of the disazo pigment used to prepare the CGL coating liquid in Example 1.

The thus prepared electrophotographic photoreceptor was evaluated in the same way as in Example 1.

The evaluation results are shown in Table 1.

Comparative Example 2

The electrophotographic photoreceptor of Comparative Example 2 was prepared in the same manner as in Example 1 except that the reflectivity measured by spectrophotometric colorimeter at a wavelength of 720 nm after the undercoat layer and CGL were formed was 13.4%.

The thus prepared electrophotographic photoreceptor was evaluated in the same way as in Example 1.

The evaluation results are shown in Table 1.

Comparative Example 3

The electrophotographic photoreceptor of Comparative Example 3 was prepared in the same manner as in Example 1 except that the reflectivity measured by spectrophotometric calorimeter at a wavelength of 720 nm after the undercoat layer and CGL were formed was 22.8%.

The thus prepared electrophotographic photoreceptor was evaluated in the same way as in Example 1.

The evaluation results are shown in Table 1.

Comparative Example 4

The electrophotographic photoreceptor of Comparative Example 4 was prepared in the same manner as in Example 1 except that the CTL was formed to have a thickness of 13 μm.

The thus prepared electrophotographic photoreceptor was evaluated in the same way as in Example 1.

The evaluation results are shown in Table 1.

Comparative Example 5

The electrophotographic photoreceptor of Comparative Example 5 was prepared in the same manner as in Example 1 except that the reflectivity of the undercoat layer and the CGL for a wavelength of 720 nm by the spectrophotometric calorimeter was 14.6%.

Comparative Example 6

The electrophotographic photoreceptor of Comparative Example 6 was prepared in the same manner as in Example 1 except that the reflectivity of the undercoat layer and the CGL for a wavelength of 720 nm by the spectrophotometric calorimeter was 21.4%.

TABLE 1

| | Electric Field Intensity (V/μm) | Reflectivity of Undercoat layer + CGL: Wavelength for measuring reflectivity | Reflectivity of Undercoat layer + CGL: % | Residual image evaluation (rank) | Abnormal Image quality |
|---|---|---|---|---|---|
| Example 1 | 16.1 | 720 nm | 17.5 | 5 | None |
| Example 2 | 25.0 | 720 nm | 17.5 | 5 | None |
| Example 3 | 15.1 | 720 nm | 17.5 | 5 | None |
| Example 4 | 31.3 | 720 nm | 17.5 | 5 | None |
| Example 5 | 16.1 | 720 nm | 18.5 | 5 | None |
| Example 6 | 16.1 | 720 nm | 16.7 | 4 | None |
| Example 7 | 16.1 | 720 nm | 19.4 | 4 | None |
| Example 8 | 16.1 | 720 nm | 20.5 | 4 | None |
| Comparative Example 1 | 16.1 | 720 nm | 17.5 | 1 | Residual Image |
| Comparative Example 2 | 16.1 | 720 nm | 13.4 | 1 | Residual Image |
| Comparative Example 3 | 16.1 | 720 nm | 22.8 | 1 | Residual Image |
| Comparative Example 4 | 38.5 | 720 nm | 17.5 | 2 | Image density decrease |
| Comparative Example 5 | 16.1 | 720 nm | 14.6 | 2 | Residual Image |
| Comparative Example 6 | 16.1 | 720 nm | 21.4 | 2 | Residual Image |

As seen in Table 1, high quality images free from residual and abnormal images were obtained in Examples satisfying the requirement of the present invention. To the contrary, in every Comparative Example, which did not satisfy the requirement of the present invention, abnormal images such as residual images and decrease in image density were observed.

Example 9

The photoreceptor of Example 1 was finished for practical use and then set in an electrophotographic apparatus remodeled based on IMAGIO NEO 270 (manufactured by Ricoh Co., Ltd.) which had been modified such that the wavelength of the light source for image irradiation was 655 nm and the LED irradiating mechanism functioning as quencher was removed, to perform a running test in which 20,000 copies of an image containing a rectangular solid image and characters were produced with an image area proportion of 5%. Thus Example 9 was performed.

The toner and developing device used are the exclusive toner and developing device of IMAGIO NEO 270.

The charger used in the electorphotographic apparatus was a short-range charging roller of the photoreceptor.

The charging conditions were as follows using an external power supply:

Voltage of AC component: 1.9 kV (peak to peak voltage)

Frequency of AC component: 1.35 kHz

Voltage of DC component: DC voltage was controlled such that the potential of the charged photoreceptor was kept at −700 V during the running test.

In addition, other conditions were as follows:

Development bias: −500 V

Environmental conditions: 24° C. 54% RH.

When the running test was complete, residual images and other image qualities were evaluated.

The produced images were visually observed to determine whether the images have a residual image. The images were graded as follows.

Rank 5: No residual image observed. Excellent

Rank 4: A very minor degree of residual image observed. Almost Excellent.

Rank 3: A minor degree of residual image observed. Practically good.

Rank 2: Some degree of residual image observed. Practically no problem.

Rank 1: Considerable residual image observed and recognized as problematic. Bad.

Other image qualities evaluated were background fouling, image density, etc.

The evaluation results are shown in Table 2.

Example 10

The test was performed in the same manner as in Example 9 for the electrophotographic photoreceptor of Example 2. Thus Comparative Example 10 was performed. The results are shown in Table 2.

Example 11

The test was performed in the same manner as in Example 9 for the electrophotographic photoreceptor of Example 3. Thus Example 11 was performed. The results are shown in Table 2.

Example 12

The test was performed in the same manner as in Example 9 for the electrophotographic photoreceptor of Example 5. Thus Example 12 was performed. The results are shown in Table 2.

Example 13

The test was performed in the same manner as in Example 9 for the electrophotographic photoreceptor of Example 6. Thus Example 13 was performed. The results are shown in Table 2.

Example 14

The test was performed in the same manner as in Example 9 for the electrophotographic photoreceptor of Example 7. Thus Example 14 was performed. The results are shown in Table 2.

Example 15

The test was performed in the same manner as in Example 9 for the electrophotographic photoreceptor of Example 8. Thus Example 15 was performed. The results are shown in Table 2.

Comparative Examples 7 to 12

The test was performed in the same manner as in Example 9 for the electrophotographic photoreceptors of Comparative Examples 1 to 6. Thus Comparative Examples 7 to 12 were performed. The results are shown in Table 2.

TABLE 2

| | Electric Field Intensity (V/μm) | Reflectivity of Undercoat layer + CGL: Wavelength for measuring reflectivity | Reflectivity of Undercoat layer + CGL: % | Residual image evaluation (rank) | Abnormal Image quality |
|---|---|---|---|---|---|
| Example 9 | 22.6 | 720 nm | 17.5 | 5 | None |
| Example 10 | 35.0 | 720 nm | 17.5 | 4 | None |
| Example 11 | 21.2 | 720 nm | 17.5 | 5 | None |
| Example 12 | 22.6 | 720 nm | 18.5 | 5 | None |
| Example 13 | 22.6 | 720 nm | 16.7 | 3 | None |
| Example 14 | 22.6 | 720 nm | 19.4 | 3 | None |
| Example 15 | 22.6 | 720 nm | 20.5 | 3 | None |
| Comparative Example 7 | 22.6 | 720 nm | 17.5 | 1 | Residual Image |
| Comparative Example 8 | 22.6 | 720 nm | 13.5 | 1 | Residual Image |
| Comparative Example 9 | 22.6 | 720 nm | 22.8 | 1 | Residual Image |
| Comparative Example 10 | 53.8 | 720 nm | 17.5 | 1 | Residual Image, Background fouling, Image density decrease |
| Comparative Example 11 | 22.6 | 720 nm | 14.6 | 2 | Residual Image |
| Comparative Example 12 | 22.6 | 720 nm | 21.4 | 2 | Residual Image |

As seen in Table 2, high quality images free from residual and abnormal images were obtained in Examples satisfying the requirement of the present invention. To the contrary, in every Comparative Example, which did not satisfy the requirement of the present invention, abnormal images such as residual images, background fouling and decrease in image density were observed.

Example 16

<Formation of Photoreceptor>

An undercoat layer coating liquid, a CGL coating liquid and a CTL coating liquid having the following compositions were prepared.

Undercoat Layer Coating Liquid

| | |
|---|---|
| Alkyd resin (BEKKOZOL 1307-60-EL from Dainippon Ink & Chemicals, Inc.) | 9 parts |
| Melamine resin (SUPER BEKKAMIN G-821-60 from Dainippon Ink & Chemicals, Inc.) | 7 parts |
| Titanium dioxide (CR-EL from Ishihara Sangyo Kaisha Ltd.) | 40 parts |
| Methyl ethyl ketone | 150 parts |

CGL Coating Liquid

| | |
|---|---|
| Disazo pigment having the following formula (M) | 4 parts |

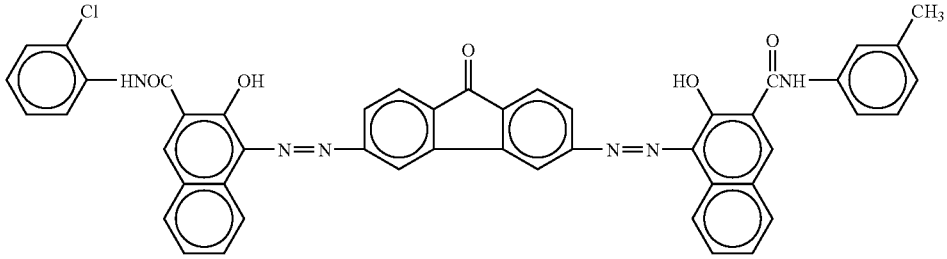

| | |
|---|---|
| Polyvinyl butyral (XYHL from Union Carbide Corp.) | 0.25 parts |
| Cyclohexanone | 200 parts |
| Methyl ethyl ketone | 80 parts |

CTL Coating Liquid

| | |
|---|---|
| CTM having the following formula: | 7 parts |

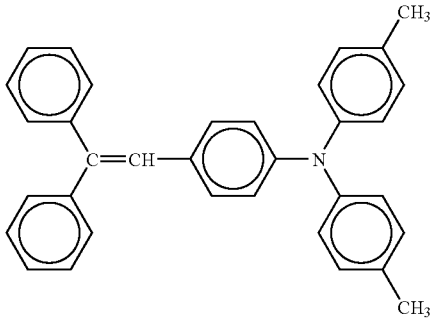

| | |
|---|---|
| Z-form polycarbonate resin (viscosity average molecular weight of 50,000, from Teijin Chemicals Ltd.) | 10 parts |
| Tetrahydrofuran | 85 parts |
| 1% tetrahydrofuran solution of silicone oil (silicone oil: KF50-100CS from Shin-Etsu Chemical Industry Co., Ltd.) | 1 part |

On an aluminum cylinder with a diameter of 30 mm, the undercoat layer coating liquid, the CGL coating liquid and the CTL coating liquid mentioned above were coated and formed accordingly by a dip coating method and then dried.

The elevating speed was controlled such that the undercoat layer was formed to have a thickness of 4.5 μm, the CGL was formed such that the light transmittance T (%) thereof for a light source wavelength of 655 nm was 45% and the CTL was formed to have a thickness of 31 μm.

<Evaluation>

The thus prepared photoreceptor was finished for practical use and then set in an electrophotographic apparatus remodeled based on IPSIO COLOR 8100 (manufactured by Ricoh Co., Ltd.) having a LD writing wavelength 655 nm to perform a running test in which 30,000 copies of an image containing a rectangular solid image and characters were produced with an image area proportion of 5%. Thus Examples 8 to 11 and Comparative Examples 9 to 12 were performed.

The toner used had an average particle diameter of 5.9 μm.

The charger used in the electorphotographic apparatus was a short-range charging roller of the photoreceptor.

The charging conditions were as follows:

Voltage of AC component: 1.9 kV (peak to peak voltage)

Frequency of AC component: 1.35 kHz

Voltage of DC component: DC voltage was controlled such that the potential of the charged photoreceptor was kept at −500 V during the running test. No quencher was provided to this electrophotographic device.

In addition, other conditions were as follows:

Development bias: −350 V

Environmental conditions: 24° C. 54% RH.

When the running test was complete, residual images and other image qualities were evaluated.

The produced images were visually observed to determine whether the images have a residual image. The images were graded as follows.

Rank 5: No residual image observed. Excellent

Rank 4: A very minor degree of residual image observed. Almost Excellent.

Rank 3: A minor degree of residual image observed. Practically good.

Rank 2: Some degree of residual image observed. Practically no problem.

Rank 1: Considerable residual image observed and recognized as problematic. Bad.

Other image qualities evaluated were background fouling, image density, etc.

The evaluation results are shown in Table 1.

Example 17

The electrophotographic photoreceptor of Example 17 was prepared in the same manner as in Example 16 except that the CTL was formed to have a thickness of 20 μm.

The thus prepared electrophotographic photoreceptor was evaluated in the same way as in Example 16.

The evaluation results are shown in Table 3.

Example 18

The electrophotographic photoreceptor of Example 18 was prepared in the same manner as in Example 16 except that the CTL was formed to have a thickness of 33 μm.

The thus prepared electrophotographic photoreceptor was evaluated in the same way as in Example 16.

The evaluation results are shown in Table 3.

Example 19

The electrophotographic photoreceptor of Example 19 was prepared in the same manner as in Example 16 except that the CTL was formed to have a thickness of 16 μm.

The thus prepared electrophotographic photoreceptor was evaluated in the same way as in Example 16.

The evaluation results are shown in Table 3.

Example 20

The electrophotographic photoreceptor of Example 20 was prepared in the same manner as in Example 16 except that the light transmittance T (%) of the CGL for a light source wavelength of 655 nm was 36%.

The thus prepared electrophotographic photoreceptor was valuated in the same way as in Example 16.

The evaluation results are shown in Table 3.

Example 21

The electrophotographic photoreceptor of Example 21 was prepared in the same manner as in Example 16 except that the light transmittance T (%) of the CGL for a light source wavelength of 655 nm was 39.2%.

The thus prepared electrophotographic photoreceptor was valuated in the same way as in Example 16.

The evaluation results are shown in Table 3.

Example 22

The electrophotographic photoreceptor of Example 22 was prepared in the same manner as in Example 16 except that the light transmittance T (%) of the CGL for a light source wavelength of 655 nm was 41%.

The thus prepared electrophotographic photoreceptor was valuated in the same way as in Example 16.

The evaluation results are shown in Table 3.

Example 23

The electrophotographic photoreceptor of Example 23 was prepared in the same manner as in Example 16 except that the light transmittance T (%) of the CGL for a light source wavelength of 655 nm was 54.1%.

The thus prepared electrophotographic photoreceptor was valuated in the same way as in Example 16.

The evaluation results are shown in Table 3.

Example 24

The electrophotographic photoreceptor of Example 24 was prepared in the same manner as in Example 16 except that the light transmittance T (%) of the CGL for a light source wavelength of 655 nm was 55.6%.

The thus prepared electrophotographic photoreceptor was valuated in the same way as in Example 16.

The evaluation results are shown in Table 3.

Example 25

The electrophotographic photoreceptor of Example 25 was prepared in the same manner as in Example 16 except that the light transmittance T (%) of the CGL for a light source wavelength of 655 nm was 64.3%.

The thus prepared electrophotographic photoreceptor was valuated in the same way as in Example 16.

The evaluation results are shown in Table 3.

Comparative Example 13

The electrophotographic photoreceptor of Comparative Example 13 was prepared in the same manner as in Example 16 except that 4 parts by weight of Y form titanyl phtalocyanine was used in place of the disazo pigment used to prepare the CGL coating liquid in Example 16.

The thus prepared electrophotographic photoreceptor was evaluated in the same way as in Example 16.

The evaluation results are shown in Table 3.

Comparative Example 14

The electrophotographic photoreceptor of Comparative Example 14 was prepared in the same manner as in Example 16 except that the light transmittance T (%) of the CGL for a light source wavelength of 655 nm was 28%.

The thus prepared electrophotographic photoreceptor was evaluated in the same way as in Example 16.

The evaluation results are shown in Table 3.

Comparative Example 15

The electrophotographic photoreceptor of Comparative Example 15 was prepared in the same manner as in Example 16 except the light transmittance T (%) of the CGL for a light source wavelength of 655 nm was 70%.

The thus prepared electrophotographic photoreceptor was evaluated in the same way as in Example 16.

The evaluation results are shown in Table 3.

Comparative Example 16

The electrophotographic photoreceptor of Comparative Example 16 was prepared in the same manner as in Example 16 except that the CTL was formed to have a thickness of 13 μm.

The thus prepared electrophotographic photoreceptor was evaluated in the same way as in Example 16.

The evaluation results are shown in Table 3.

Comparative Example 17

The electrophotographic photoreceptor of Comparative Example 17 was prepared in the same manner as in Example 16 except that the light transmittance T (%) of the CGL for a light source wavelength of 655 nm was 34.5%.

The thus prepared electrophotographic photoreceptor was evaluated in the same way as in Example 16.

The evaluation results are shown in Table 3.

Comparative Example 18

The electrophotographic photoreceptor of Comparative Example 18 was prepared in the same manner as in Example 16 except that the light transmittance T (%) of the CGL for a light source wavelength of 655 nm was 66%.

The thus prepared electrophotographic photoreceptor was evaluated in the same way as in Example 16.

The evaluation results are shown in Table 3.

TABLE 3

| | Electric Field | Light Transmittance of the CGL | | Residual image | Abnormal |
|---|---|---|---|---|---|
| | Intensity (V/μm) | Writing wavelength | % | evaluation (rank) | Image quality |
| Example 16 | 16.1 | 655 nm | 45 | 5 | None |
| Example 17 | 25.0 | 655 nm | 45 | 5 | None |
| Example 18 | 15.1 | 655 nm | 45 | 5 | None |
| Example 19 | 31.3 | 655 nm | 45 | 5 | None |
| Example 20 | 16.1 | 655 nm | 36 | 3 | None |
| Example 21 | 16.1 | 655 nm | 39.2 | 4 | None |
| Example 22 | 16.1 | 655 nm | 41 | 5 | None |
| Example 23 | 16.1 | 655 nm | 54.1 | 5 | None |
| Example 24 | 16.1 | 655 nm | 55.6 | 4 | None |
| Example 25 | 16.1 | 655 nm | 64.3 | 3 | None |
| Comparative Example 13 | 16.1 | 655 nm | 45 | 1 | Residual Image |
| Comparative Example 14 | 16.1 | 655 nm | 28 | 1 | Residual Image |
| Comparative Example 15 | 16.1 | 655 nm | 70 | 1 | Residual Image |
| Comparative Example 16 | 38.5 | 655 nm | 45 | 2 | Image density decrease |
| Comparative Example 17 | 16.1 | 655 nm | 34.5 | 2 | Residual Image |
| Comparative Example 18 | 16.1 | 655 nm | 66 | 2 | Residual Image |

As seen in Table 3, high quality images free from residual and abnormal images were obtained in Examples satisfying the requirement of the present invention. To the contrary, in every Comparative Example, which did not satisfy the requirement of the present invention, abnormal images such as residual images and decrease in image density were observed.

Example 26

The photoreceptor of Example 16 was finished for practical use and then set in an electrophotographic apparatus remodeled based on IMAGIO NEO 270 (manufactured by Ricoh Co., Ltd.) which had been modified such that the wavelength of the light source for image irradiation was 655 nm and the LED irradiating mechanism functioning as quencher was removed, to perform a running test in which 20,000 copies of an image containing a rectangular solid image and characters were produced with an image area proportion of 5%. Thus Example 26 was performed.

The toner and developing device used are the exclusive toner and developing device of IMAGIO NEO 270.

The charger used in the electorphotographic apparatus was a short-range charging roller of the photoreceptor.

The charging conditions were as follows using an external power supply:

Voltage of AC component: 1.9 kV (peak to peak voltage)

Frequency of AC component: 1.35 kHz

Voltage of DC component: DC voltage was controlled such that the potential of the charged photoreceptor was kept at −700 V during the running test.

In addition, other conditions were as follows.

Development bias: −500 V

Environmental conditions: 24° C. 54% RH.

When the running test was complete, residual images and other image qualities were evaluated.

The produced images were visually observed to determine whether the images have a residual image. The images were graded as follows.

Rank 5: No residual image observed. Excellent

Rank 4: A very minor degree of residual image observed. Almost Excellent.

Rank 3: A minor degree of residual image observed. Practically good.

Rank 2: Some degree of residual image observed. Practically no problem.

Rank 1: Considerable residual image observed and recognized as problematic. Bad.

Other image qualities evaluated were background fouling, image density, etc.

The evaluation results are shown in Table 4.

Example 27

The test was performed in the same manner as in Example 26 for the electrophotographic photoreceptor of Example 17. Thus Example 27 was performed. The results are shown in Table 4.

Example 28

The test was performed in the same manner as in Example 26 for the electrophotographic photoreceptor of Example 18. Thus Example 28 was performed. The results are shown in Table 4.

Example 29

The test was performed in the same manner as in Example 26 for the electrophotographic photoreceptor of Example 20. Thus Example 29 was performed. The results are shown in Table 4.

Example 30

The test was performed in the same manner as in Example 26 for the electrophotographic photoreceptor of Example 21. Thus Example 30 was performed. The results are shown in Table 4.

Example 31

The test was performed in the same manner as in Example 26 for the electrophotographic photoreceptor of Example 22. Thus Example 29 was performed. The results are shown in Table 4.

Example 32

The test was performed in the same manner as in Example 26 for the electrophotographic photoreceptor of Example 23. Thus Example 32 was performed. The results are shown in Table 4.

Example 33

The test was performed in the same manner as in Example 26 for the electrophotographic photoreceptor of Example 24. Thus Example 33 was performed. The results are shown in Table 4.

Example 34

The test was performed in the same manner as in Example 26 for the electrophotographic photoreceptor of Example 25. Thus Example 34 was performed. The results are shown in Table 4.

Comparative Examples 19 to 24

The test was performed in the same manner as in Example 26 for the electrophotographic photoreceptors of Comparative Examples 13 to 18. Thus Comparative Examples 19 to 24 were performed. The results are shown in Table 4.

TABLE 4

| | Electric Field | Light transmittance of the CGL | | Residual image | Abnormal |
|---|---|---|---|---|---|
| | Intensity (V/μm) | Writing wavelength | % | evaluation (rank) | Image quality |
| Example 26 | 22.6 | 655 nm | 45 | 5 | None |
| Example 27 | 35.0 | 655 nm | 45 | 5 | None |
| Example 28 | 21.2 | 655 nm | 45 | 5 | None |
| Example 29 | 22.6 | 655 nm | 36 | 3 | None |
| Example 30 | 22.6 | 655 nm | 39.2 | 4 | None |
| Example 31 | 22.6 | 655 nm | 41 | 5 | None |
| Example 32 | 22.6 | 655 nm | 54.1 | 5 | None |
| Example 33 | 22.6 | 655 nm | 55.6 | 4 | None |
| Example 34 | 22.6 | 655 nm | 64.3 | 3 | None |
| Comparative Example 19 | 22.6 | 655 nm | 45 | 1 | Residual Image |
| Comparative Example 20 | 22.6 | 655 nm | 28 | 1 | Residual Image |
| Comparative Example 21 | 22.6 | 655 nm | 70 | 1 | Residual Image |
| Comparative Example 22 | 53.8 | 655 nm | 45 | 2 | Image density decrease |
| Comparative Example 23 | 22.6 | 655 nm | 34.5 | 2 | Residual Image |
| Comparative Example 24 | 22.6 | 655 nm | 66 | 2 | Residual Image |

As seen in Table 4, high quality images free from residual and abnormal images were obtained in Examples satisfying the requirement of the present invention. To the contrary, in every Comparative Example, which did not satisfy the requirement of the present invention, abnormal images such as residual images, background fouling and decrease in image density were observed.

As mentioned above, since the electrophotographic apparatus of the present invention is capable of producing quality images free from abnormal image problems such as residual images, background fouling and decrease in image density, the electrophotographic apparatus of the present invention has a practical value for photocopiers, facsimile machines, laser printers, direct digital plate making machines, etc.

This document claims priority and contains subject matter related to Japanese Patent Applications No. 2003-324986 and 2003-391070, filed on Sep. 17, 2003, and Nov. 20, 2003, respectively, incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. An electrophotographic photoreceptor, comprising:

a conductive substrate;

an undercoat layer located overlying the conductive substrate;

a photosensitive layer located overlying the undercoat layer and comprising:

a charge generation layer located overlying the undercoat layer; and a charge transport layer located overlying the charge generation layer, wherein, when the charge generation layer is irradiated in the absence of the charge transport layer with light in a range of from 360 nm to 740 nm having the highest reflectivity for the charge generation layer, the charge generation layer has a reflectivity of from 15 to 21%, and wherein the electrophotographic photoreceptor satisfies the following relationship:

12 (V/μm) ≦ electric field intensity (V/D)≦35 (V/μm), wherein D (μm) represents a thickness of the charge transport layer of the electrophotographic photoreceptor and V (V) represents an absolute potential of the surface of the electrophotographic photoreceptor due to charging.

2. The electrophotographic photoreceptor according to claim 1, wherein the charge generation layer comprises a disazo pigment represented by the following formula (I):

(I)

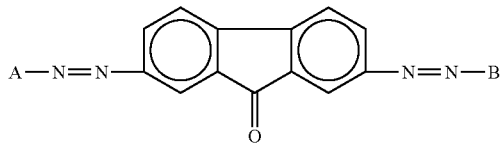

wherein, A and B represent coupler remaining groups represented by the following formulae (II) to (VIII);

(II)

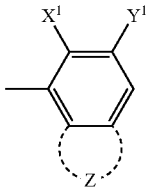

wherein, $X^1$ represents —OH, —$NHCOCH_3$, and —$NHSO_2CH_3$, $Y^1$ represents—$CON(R^2)(R^3)$, —$CONHN{=}C(R^6)(R^7)$, —$CONHN(R^8)(R^9)$,—$CONHCONH(R^{12})$, a hydrogen atom, COOH, —$COOCH_3$, $COOC_6H_5$ and a benzimidazol group, wherein $R^2$ and $R^3$ independently represent a hydrogen atom, a substituted or non-substituted alkyl group, a substituted or non-substituted aryl group and a substituted or non-substituted heterocyclic group or wherein $R^2$ and $R^3$ when taken together can form a ring with the nitrogen atom they are bonded to, $R^6$ and $R^7$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^6$ and $R^7$ when taken together can form a ring with the nitrogen atom they are bonded to, $R^8$ and $R^9$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^8$ and $R^9$ when taken together with the carbon atom they are bonded to can form a five-membered ring or six-membered ring optionally having a condensed aromatic ring, and $R^{12}$ represents a substituted or non-substituted alkyl group, a substituted or non-substituted aryl group and a substituted or non-substituted heterocyclic group, and Z represents a remaining group which is fused with the benzene ring to form a polycyclic aromatic structure or a heterocyclic structure selected from the group consisting of a naphthalene ring, an anthracene ring, a carbazole ring, a benzocarbazole ring, a dibenzocarbazole ring, a dibenzofuran ring, a benzonaphthofuran ring and a dibenzothiophene ring, each of which can have at least one substituent;

(III)

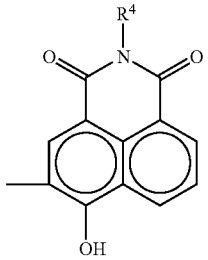

wherein $R^4$ represents a hydrogen atom, a substituted or non-substituted alkyl group, and a substituted or non-substituted aryl group;

(IV)

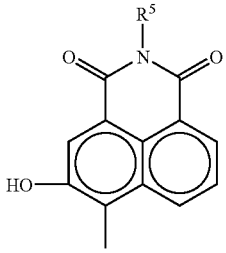

wherein $R^5$ represents a hydrogen atom, a substituted or non-substituted alkyl group, and a substituted or non-substituted aryl group;

(V)

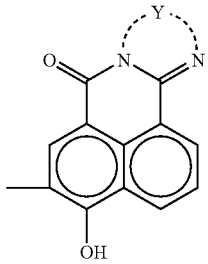

wherein Y represents a divalent aromatic hydrocarbon group or wherein Y together with the N-atoms it is bonded to forms a heterocyclic group;

(VI)

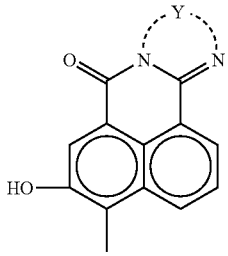

wherein Y represents a divalent aromatic hydrocarbon or wherein Y together with the N-atoms it is bonded to forms a heterocyclic group;

(VII)

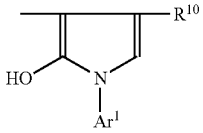

wherein $R^{10}$ represents a hydrogen atom, an alkyl group, a carboxyl group, and a carboxyester group and $Ar^1$ is a substituted or non-substituted aromatic hydrocarbon group; and (VIII)

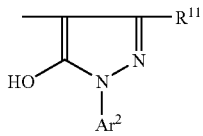

wherein $R^{11}$ represents a hydrogen atom, an alkyl group, a carboxyl group, and a carboxyester and $Ar^2$ is a substituted or non-substituted aromatic hydrocarbon group.

3. The electrophotographic photoreceptor according to claim 1, wherein the charge generation layer comprises a disazo pigment represented by the following formula (1)

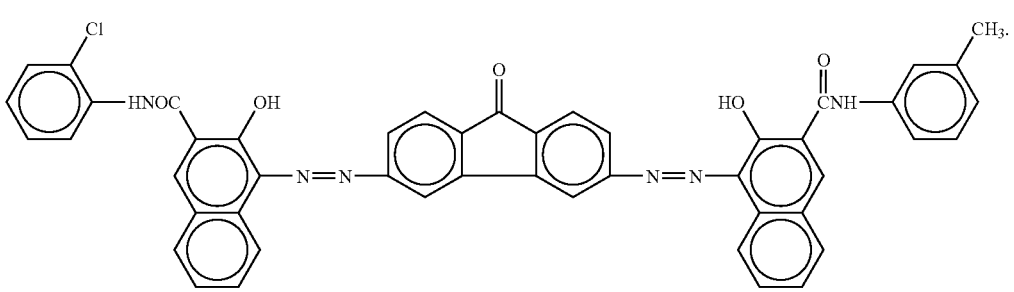

(1)

4. The electrophotographic photoreceptor according to claim 1, wherein the charge generation layer has a reflectivity of from 17 to 19%.

5. An electrophotographic apparatus, comprising:

the electrophotographic photoreceptor of claim 1;

a charger configured to uniformly charge a surface of the photoreceptor;

an image irradiator configured to irradiate the uniformly charged electrophotographic photoreceptor with light to form a latent electrostatic image thereon;

a developing device configured to develop the latent electrostatic image with a toner;

a transfer device configured to transfer the developed image to a receiving material; and a cleaner configured to remove any toner remaining on the photoreceptor.

6. The electrophotographic apparatus according to claim 5, wherein the electrophotographic photoreceptor satisfies the following relationship:

15 (V/μm) ≦ electric field intensity (V/D)≦32 (V/μm).

7. The electrophotographic apparatus according to claim 5, wherein the toner for use in developing the latent electrostatic image has a sphere form.

8. The electrophotographic apparatus according to claim 5, further comprising:

an intermediate transfer device to which multiple separate color toner images developed on the electrophotographic photoreceptor with separate color toners are transferred in a first step to form an overlaid color toner image on the intermediary transfer device while overlaying the separate color images thereon and from which the overlaid color toner image is transferred in a second step to the receiving material.

9. A process cartridge, comprising:

the electrophotographic photoreceptor of claim 1; and at least one of a charger configured to uniformly charge a surface of the electrophotographic photoreceptor;

an image irradiator configured to irradiate the uniformly charged electrophotographic photoreceptor with light to form a latent electrostatic image thereon;

a developing device configured to develop the latent electrostatic image with a toner;

a transfer device configured to transfer the developed image to a receiving material;

a cleaner configured to remove any toner remaining on the electrophotographic photoreceptor; and a quencher configured to discharge the surface of the electrophotographic photoreceptor.

10. A method of manufacturing the electrophotographic photoreceptor according to claim 1, comprising:

forming a conductive substrate;

forming an undercoat layer located overlying the conductive substrate; and forming a charge generation layer located overlying the undercoat layer; and forming a charge transport layer located overlying the charge generation layer, wherein, when the charge generation layer is irradiated in the absence of the charge transport layer with light in a range of from 360 nm to 740 nm having the highest reflectivity for the charge generation layer, the charge generation layer has a reflectivity of from 15 to 21%.

11. The electrophotographic photoreceptor according to claim 1, wherein the electrophotographic photoreceptor satisfies the following relationship:

15 (V/μm)≦electric field intensity (V/D)≦32 (V/μm).

12. An electrophotographic apparatus, comprising:

an electrophotographic photoreceptor comprising:

a conductive substrate;

an undercoat layer located overlying the conductive substrate;

a photosensitive layer located overlying the undercoat layer and comprising:

a charge generation layer located overlying the undercoat layer comprising a disazo pigment and having a light transmittance of from 35 to 65% against light to form a latent electrostatic image on the electrophotographic photoreceptor; and a charge transport layer located overlying the charge generation layer;

a charger configured to uniformly charge a surface of the electrophotographic photoreceptor;

an image irradiator configured to irradiate the uniformly charged electrophotographic photoreceptor with the light to form a latent electrostatic image thereon;

a developing device configured to develop the latent electrostatic image with a toner;

a transfer device configured to transfer the developed image to a receiving material; and a cleaner configured to remove any toner remaining on the electrophotographic photoreceptor, wherein the electrophotographic photoreceptor satisfies the following relationship:

12 (V/μm)≦electric field intensity (V/D)≦35 (V/μm), wherein D (μm) represents a thickness of the charge transport layer of the electrophotographic photoreceptor and V (V) represents an absolute potential of the surface of the electrophoto graphic photoreceptor due to charging, and wherein the disazo pigment is represented by the following formula (I):

(I)

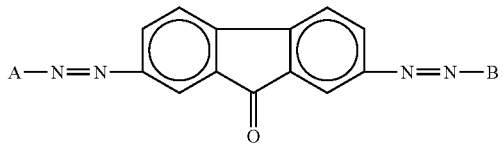

wherein, A and B represent coupler remaining groups represented by the following formulae (II) to (VIII);

(II)

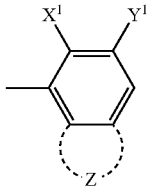

wherein, $X^1$ represents —OH, —$NHCOCH_3$, and —$NHSO_2CH_3$, $Y^1$ represents—$CON(R^2)(R^3)$, —$CONHN{=}C(R^6)(R^7)$, —$CONHN(R^8)(R^9)$,—$CONHCONH(R^{12})$, a hydrogen atom, COOH, —$COOCH_3$, $COOC_6H_5$ and a benzimidazol group, wherein $R^2$ and $R^3$ independently represent a hydrogen atom, a substituted or non-substituted alkyl group, a substituted or non-substituted aryl group and a substituted or non-substituted heterocyclic group or wherein $R^2$ and $R^3$ when taken together can form a ring with the nitrogen atom they are bonded to, $R^6$ and $R^7$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^6$ and $R^7$ when taken together can form a ring with the nitrogen atom they are bonded to, $R^8$ and $R^9$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^8$ and $R^9$ when taken together with the carbon atom they are bonded to can form a five-membered ring or six-membered ring optionally having a condensed aromatic ring, and $R^{12}$ represents a substituted or non-substituted alkyl group, a substituted or non-substituted aryl group and a substituted or non-substituted heterocyclic group, and Z represents a remaining group which is fused with the benzene ring to form a polycyclic aromatic structure or a heterocyclic structure selected from the group consisting of a naphthalene ring, an anthracene ring, a carbazole ring, a benzocarbazole ring, a dibenzocarbazole ring, a dibenzofuran ring, a benzonaphthofuran ring and a dibenzothiophene ring, each of which can have at least one substituent;

(III)

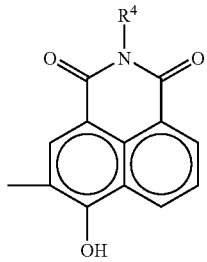

wherein $R^4$ represents a hydrogen atom, a substituted or non-substituted alkyl group, and a substituted or non-substituted aryl group;

(IV)

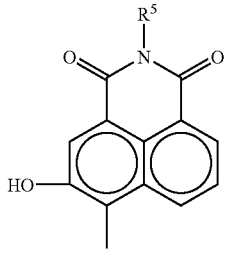

wherein $R^5$ represents a hydrogen atom, a substituted or non-substituted alkyl group, and a substituted or non-substituted aryl group;

(V)

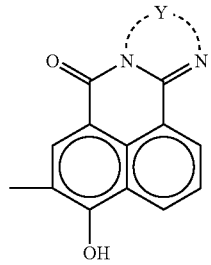

wherein Y represents a divalent aromatic hydrocarbon group or wherein Y together with the N-atoms it is bonded to forms a heterocyclic group;

(VI)

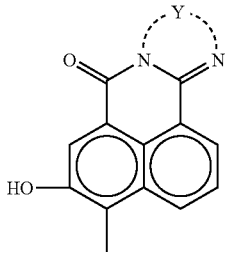

wherein Y represents a divalent aromatic hydrocarbon or wherein Y together with the N-atoms it is bonded to forms a heterocyclic group;

(VII)

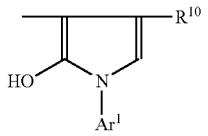

wherein $R^{10}$ represents a hydrogen atom, an alkyl group, a carboxyl group, and a carboxyester group and $Ar^1$ is a substituted or non-substituted aromatic hydrocarbon group; and (VIII)

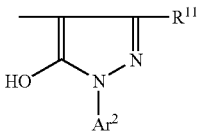

wherein $R^{11}$ represents a hydrogen atom, an alkyl group, a carboxyl group, and a carboxyester and $Ar^2$ is a substituted or non-substituted aromatic hydrocarbon group.

13. The electrophotographic apparatus according to claim 12, wherein the charge generation layer includes a disazo pigment represented by the following formula (1)

(1)

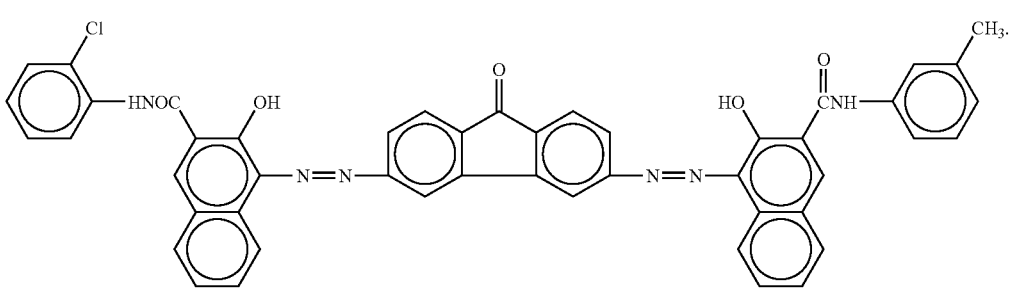

14. The electrophotographic apparatus according to claim 12, wherein the charge generation layer has a light transmittance of from 40 to 55%.

15. The electrophotographic apparatus according to claim 12, wherein the electrophotographic photoreceptor satisfies the following relationship:

15 (Vμm)≦electric field intensity (V/D)≦32 (V/μm).

16. The electrophotographic apparatus according to claim 12, wherein the toner for use in developing the latent electrostatic image has a sphere form.

17. The electrophotographic apparatus according to claim 12, further comprising:

an intermediate transfer device to which multiple separate color toner images developed on the electrophotographic photoreceptor with separate color toners are transferred in a first step to form an overlaid color toner image on the intermediary transfer device while overlaying the separate color images thereon and from which the overlaid color toner image is transferred in a second step to the receiving material.

18. A process cartridge comprising:

an electrophotographic photoreceptor comprising:

a conductive substrate;

an undercoat layer located overlying the conductive substrate;

a photosensitive layer located overlying the undercoat layer and comprising:

a charge generation layer comprising a disazo pigment and having a light transmittance of from 35 to 65% against light to form a latent electrostatic image on the electrophotographic photoreceptor; and a charge transport layer located overlying the charge generation layer;

an image irradiator configured to irradiate the uniformly charged electrophotographic photoreceptor with the light to form a latent electrostatic image thereon; and at least one of a charger configured to uniformly charge a surface of the electrophotographic photoreceptor;

a developing device configured to develop the latent electrostatic image with a toner;

a transfer device configured to transfer the developed image to a receiving material;

a cleaner configured to remove any toner remaining on the electrophotographic photoreceptor; and a quencher configured to discharge the surface of the electrophotographic photoreceptor, wherein the electrophotographic photoreceptor satisfies the following relationship:

12 (V/μm)≦electric field intensity (V/D)≦35 (V/μm), wherein D (μm) represents a thickness of the charge transport layer of the electrophotographic photoreceptor and V (V) represents an absolute potential of the surface of the electrophotographic photoreceptor due to charging, and wherein the disazo pigment is represented by the following formula (I):

(I)

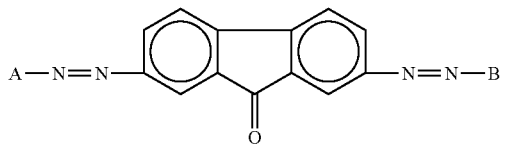

wherein, A and B represent coupler remaining groups represented by the following formulae (II) to (VIII);

(II)

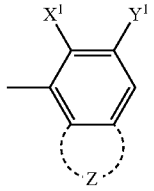

wherein, $X^1$ represents —OH, —$NHCOCH_3$, and —$NHSO_2CH_3$, $Y^1$ represents—$CON(R^2)(R^3)$, —$CONHN{=}C(R^6)(R^7)$, —$CONHN(R^8)(R^9)$,—$CONHCONH(R^{12})$, a hydrogen atom, COOH, —$COOCH_3$, $COOC_6H_5$ and a benzimidazol group, wherein $R^2$ and $R^3$ independently represent a hydrogen atom, a substituted or non-substituted alkyl group, a substituted or non-substituted aryl group and a substituted or non-substituted heterocyclic group or wherein $R^2$ and $R^3$ when taken together can form a ring with the nitrogen atom they are bonded to, $R^6$ and $R^7$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^6$ and $R^7$ when taken together can form a ring with the nitrogen atom they are bonded to, $R^8$ and $R^9$ independently represent a hydrogen atom, a substituted or non-substituted alkyl group, a substituted or non-substituted aralkyl group, a substituted or non-substituted aryl group, a substituted or non-substituted styryl group and a substituted or non-substituted heterocyclic group or wherein $R^8$ and $R^9$ when taken together with the carbon atom they are bonded to can form a five-membered ring or six-membered ring optionally having a condensed aromatic ring, and $R^{12}$ represents a substituted or non-substituted alkyl group, a substituted or non-substituted aryl group and a substituted or non-substituted heterocyclic group, and Z represents a remaining group which is fused with the benzene ring to form a polycyclic aromatic structure or a heterocyclic structure selected from the group consisting of a naphthalene ring, an anthracene ring, a carbazole ring, a benzocarbazole ring, a dibenzocarbazole ring, a dibenzofuran ring, a benzonaphthofuran ring and a dibenzothiophene ring, each of which can have at least one substituent;

(III)

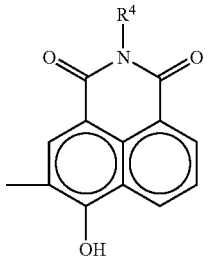

wherein $R^4$ represents a hydrogen atom, a substituted or non-substituted alkyl group, and a substituted or non-substituted aryl group;

(IV)

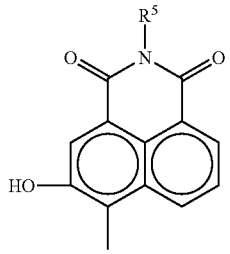

wherein $R^5$ represents a hydrogen atom, a substituted or non-substituted alkyl group, and a substituted or non-substituted aryl group;

(V)

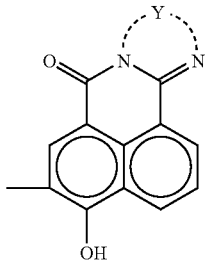

wherein Y represents a divalent aromatic hydrocarbon group or wherein Y together with the N-atoms it is bonded to forms a heterocyclic group;

(VI)

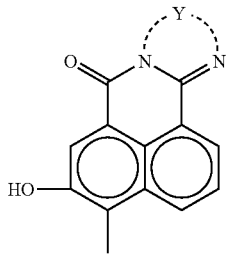

wherein Y represents a divalent aromatic hydrocarbon or wherein Y together with the N-atoms it is bonded to forms a heterocyclic group;

(VII)

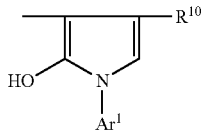

wherein $R^{10}$ represents a hydrogen atom, an alkyl group, a carboxyl group, and a carboxyester group and $Ar^1$ is a substituted or non-substituted aromatic hydrocarbon group; and

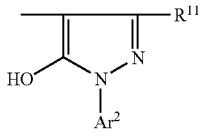
(VIII)
wherein $R^{11}$ represents a hydrogen atom, an alkyl group, a carboxyl group, and a carboxyester and $Ar^2$ is a substituted or non-substituted aromatic hydrocarbon group.
* * * * *